US011465174B2

(12) United States Patent
Wang et al.

(10) Patent No.: US 11,465,174 B2
(45) Date of Patent: Oct. 11, 2022

(54) OMNIPHILIC, OMNIPHOBIC, SWITCHABLE, AND SELECTIVE WETTING SURFACES

(71) Applicant: MASSACHUSETTS INSTITUTE OF TECHNOLOGY, Cambridge, MA (US)

(72) Inventors: Evelyn Wang, Cambridge, MA (US); Kyle Wilke, Boston, MA (US); Zhengmao Lu, Cambridge, MA (US); Youngsup Song, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 16/882,522

(22) Filed: May 24, 2020

(65) Prior Publication Data

US 2020/0368778 A1 Nov. 26, 2020

Related U.S. Application Data

(60) Provisional application No. 62/852,316, filed on May 24, 2019.

(51) Int. Cl.

| | |
|---|---|
| ***B05D 5/08*** | (2006.01) |
| ***B05D 7/00*** | (2006.01) |
| ***B05D 7/24*** | (2006.01) |

(52) U.S. Cl.

CPC ..... *B05D 5/08* (2013.01); *B05D 7/24* (2013.01); *B05D 7/51* (2013.01)

(58) Field of Classification Search

CPC ..... B05D 5/08; B05D 7/24

See application file for complete search history.

(56) References Cited

U.S. PATENT DOCUMENTS

| | | | | |
|---|---|---|---|---|
| 2014/0017145 | A1* | 1/2014 | Aizenberg | C08G 59/502 422/425 |
| 2016/0207083 | A1* | 7/2016 | Kim | B05D 5/00 |
| 2018/0118957 | A1* | 5/2018 | Brown | C09D 123/12 |

OTHER PUBLICATIONS

Brown et al., "Durable, superoleophobic polymer-nanoparticle composite surfaces with re-entrant geometry via solvent-induced phase transformation" (Year: 2016).*

* cited by examiner

*Primary Examiner* — Nathan T Leong

(74) *Attorney, Agent, or Firm* — Honigman LLP

(57) ABSTRACT

A surface with selective wetting properties is described.

7 Claims, 21 Drawing Sheets

OMNIPHILIC, OMNIPHOBIC, SWITCHABLE, AND SELECTIVE WETTING SURFACES

PRIORITY STATEMENT

This application claims priority to U.S. Provisional Application No. 62/852,316, filed May 24, 2019, which is incorporated by reference in its entirety.

FEDERAL SPONSORSHIP

This invention was made with Government support under Grant No. FA9550-15-1-0310 awarded by the Air Force Office of Scientific Research (AFOSR). The Government has certain right in the invention.

FIELD OF THE INVENTION

The present disclosure relates to wetting surfaces.

BACKGROUND

Wetting properties of surfaces can be important in a number of applications.

SUMMARY

This invention relates to a selective wetting surface and methods of selecting or modifying the wetting behavior of a surface.

In one aspect, the surface can include a reentrant structure on a surface having a bistable surface, wherein the surface is omniphobic or omniphilic or selectively repelling or wicking, wherein the surface is switchable between repelling, wicking or selective.

In another aspect, a method of switching a wetting characteristic of a surface can include providing a surface including a reentrant structure on the surface having a bistable surface, and selecting the wetting characteristic of the surface to be omniphobic or omniphilic or selectively repelling or wicking, wherein the surface is switchable between repelling, wicking or selective.

In certain circumstances, selective can include repelling or wicking a particular liquid or set of liquids. The particular liquid can be a liquid that is selected from a group of liquids.

In certain circumstances, the reentrant structure can include a doubly reentrant structure.

In certain circumstances, the reentrant structure can include microchannels, pillars or cavities.

In certain circumstances, the reentrant structure is a coated structure.

In certain circumstances, the reentrant structure can be filled with a liquid.

In certain circumstances, selecting the wetting characteristic can include placing a liquid in the reentrant structure. In certain circumstances, the liquid can be a non-wetting liquid for the surface. In certain circumstances, the liquid can be a wetting liquid for the surface.

In certain circumstances, the surface can be a selective wetting surface as described herein.

Other aspects, embodiments, and features will be apparent from the following description, the drawings, and the claims.

BRIEF DESCRIPTION OF THE DRAWINGS

FIG. 3A shows a reentrant structure initially filled with a non-wetting liquid (i) begins emptying (ii). The three-phase contact line pins at the reentrant feature (iii) which produces a surface tension force, F, that prevents liquid from being removed further regardless of contact angle, θ (iv). Therefore, the structure is unable to empty completely (v) and the surface remains wicking. FIG. 3B shows a reentrant structure initially filled with air (i) begins filling with a wetting liquid from above (ii). The three-phase contact line pins at the reentrant feature (iii) which produces a surface tension force, F, that prevents liquid from entering the structure further regardless of contact angle, θ (iv). Therefore, the structure is unable to fill completely (v) and the surface remains repellent. FIG. 3C shows the total surface energy while a wetting liquid is added to a reentrant structure (blue line) and while a non-wetting liquid is removed from the structure (dashed grey line). States i through v from FIG. 3A and FIG. 3B are labeled. The surface is always bistable regardless of whether a wetting or non-wetting liquid is used due to contact line pinning between states ii and iv, enabling both repellency and wicking for all liquids. Line segments i-ii and iv-v capture the overall change in surface energy between these states which were not solved explicitly given the dependence on the specific geometry and liquid path.

FIG. 4A shows a top view of a 3D schematic of the surfaces consisting of parallel channels. Although only four channels are depicted, surfaces had up to 10 to allow for sufficient area to characterize the apparent contact angle on the surface. FIG. 4B shows a cross-sections of the 3D schematic for normal channels (left) and reentrant channels (right). FIG. 4C shows a cross-section scanning electron microscope images of a cleaved section of a reentrant channel surface used in this work. FIG. 4D shows an apparent advancing contact angle (cos θ*) on normal and reentrant microstructures parallel to the channels for liquids with different intrinsic wettability (cos θ). The normal channels highlight typical behavior, where non-wetting liquids form a Cassie wetting state with large apparent contact angle, while wetting liquids form a hemiwicking state with small apparent contact angle. Reentrant features, however, enable both of these states to be extended to all liquids, regardless of intrinsic wettability. Data from a few select previous works is also shown. FIG. 4E shows images of a wetting liquid (ethanol) and a non-wetting liquid (mercury).

The first column shows the liquids on a smooth surface (intrinsic contact angle). Reentrant surfaces were able to achieve both wicking (blue box) and repellency (red box) for both liquids despite their intrinsic wetting behaviors.

Figure 5A:
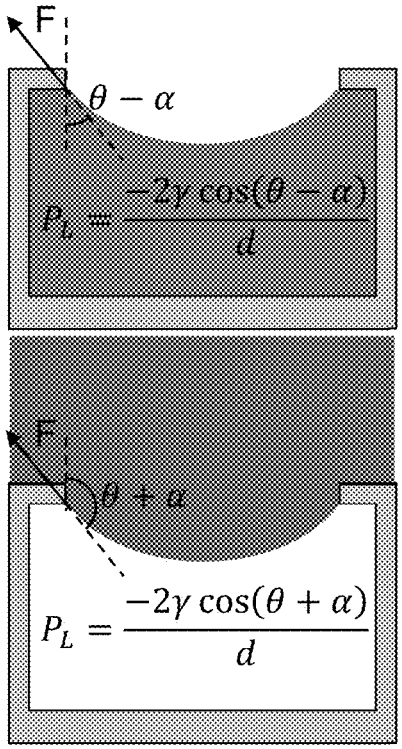
Figure 5B:
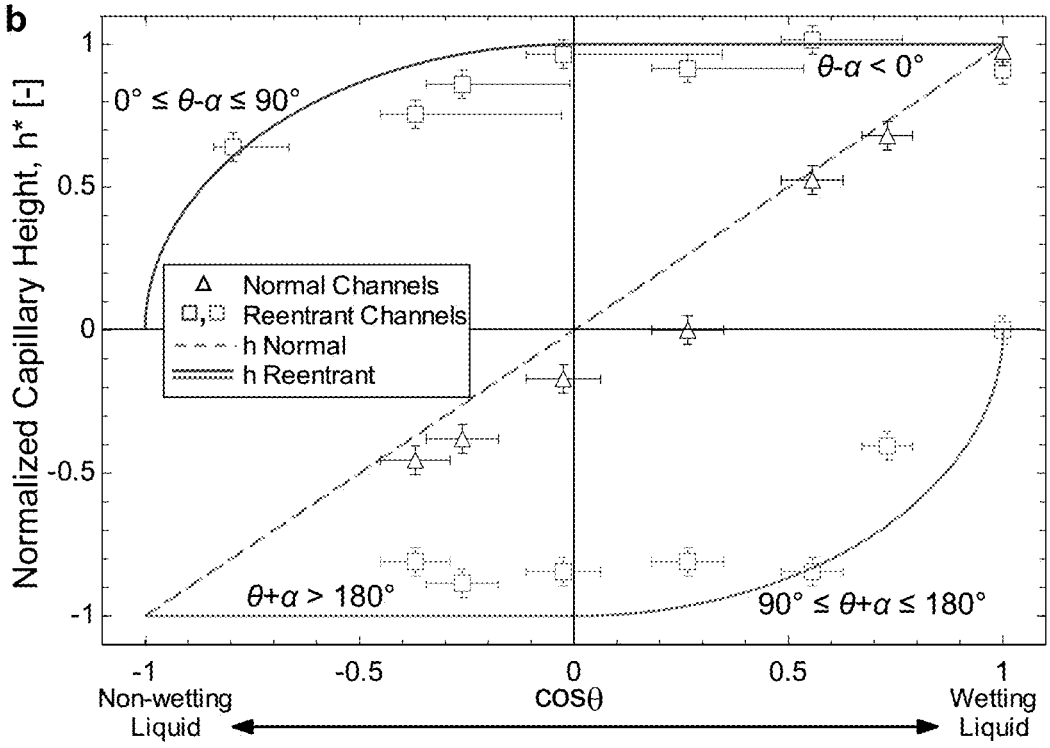
Figures 5C, 5D:
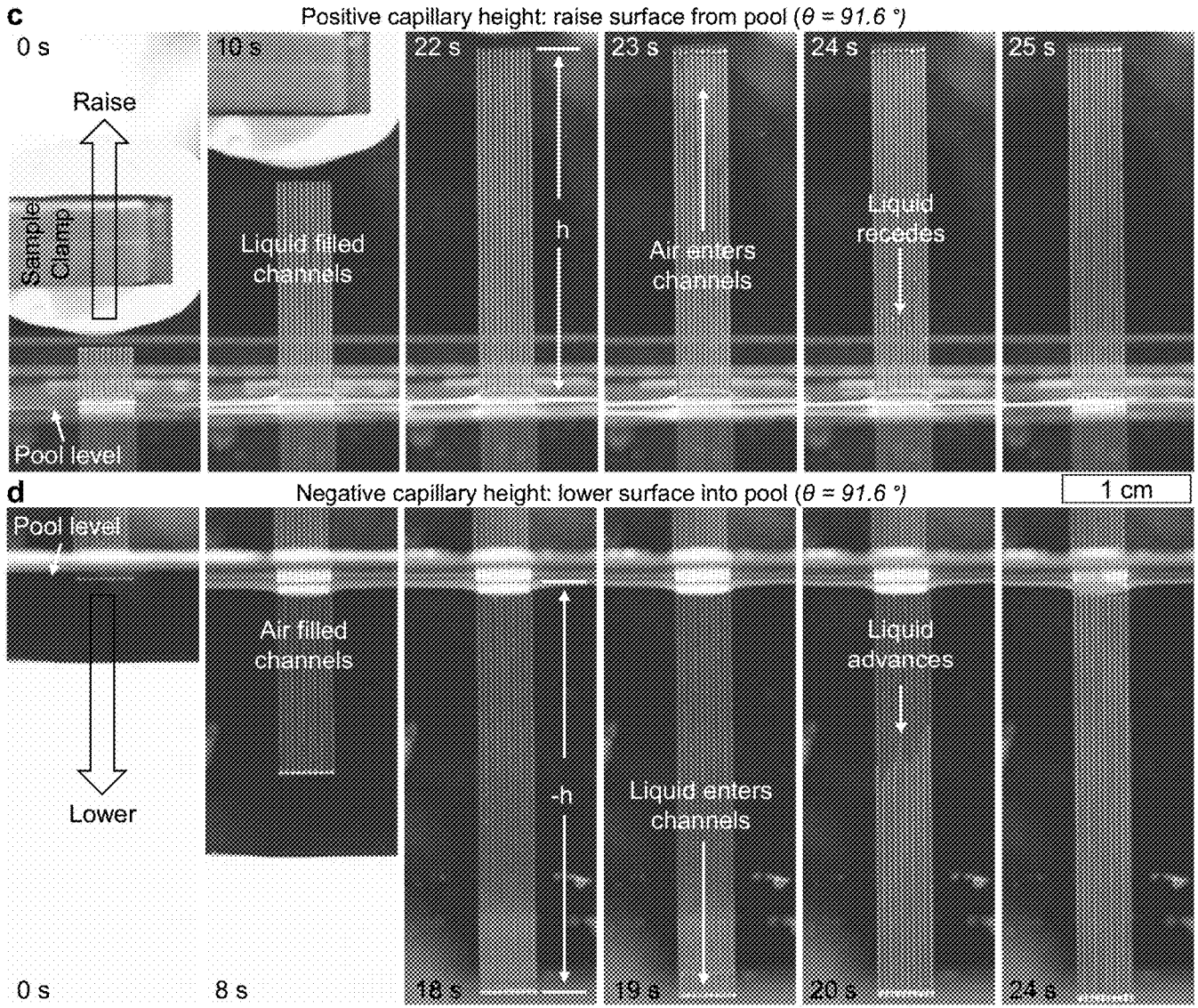

FIGS. 5A-5C depict both positive and negative Laplace pressures on the same surface. FIG. 5A shows schematics of the liquid-gas interface curvature that generates the Laplace pressure, PL. FIG. 5B shows normalized capillary height on normal and reentrant channels for liquids with different intrinsic wettability. The normal channels highlight typical behavior, where non-wetting liquids trap air to a given liquid depth and wetting liquids fill the roughness to a given height (black triangles). Reentrant channels dipped in liquid, however, trapped air for wetting liquids as well (red, lower, squares). Furthermore, when prefilled with liquid, reentrant channels allowed a positive capillary height for all liquids (blue, upper, squares). FIG. 5C shows time-lapse images showing reentrant channels prefilled with liquid with $\theta=91.6°$ being raised from a pool of the same liquid. Once the capillary height was exceeded, the channel naturally dewet. This corresponded to the bistable surface transitioning from its local energy minimum hemiwicking state into its global energy minimum state. The liquid is false coloured blue for convenience. FIG. 5D shows time-lapse images showing reentrant channels filled with air being dipped into a pool of liquid with $\theta=91.6°$. Once the capillary height was exceeded, liquid entered the channels. This corresponded to the bistable surface transitioning from its local energy minimum repellent state into its global energy minimum state.

Figure 6A:
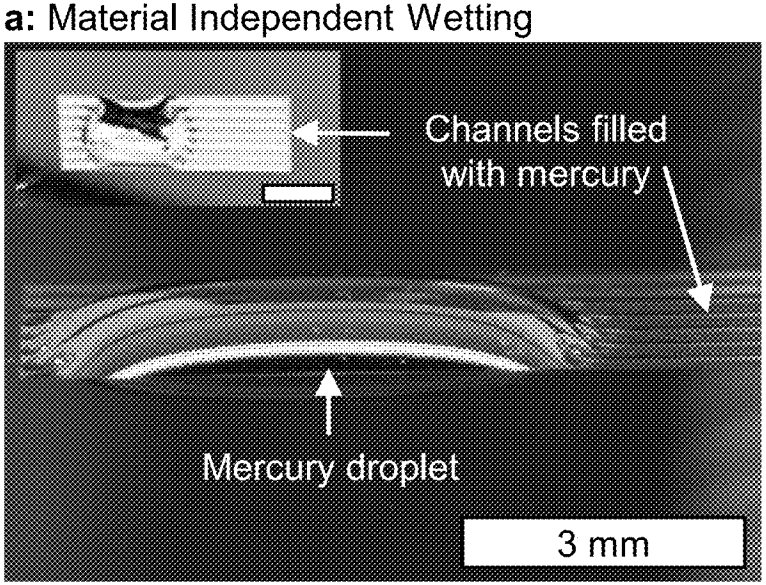
Figure 6B:
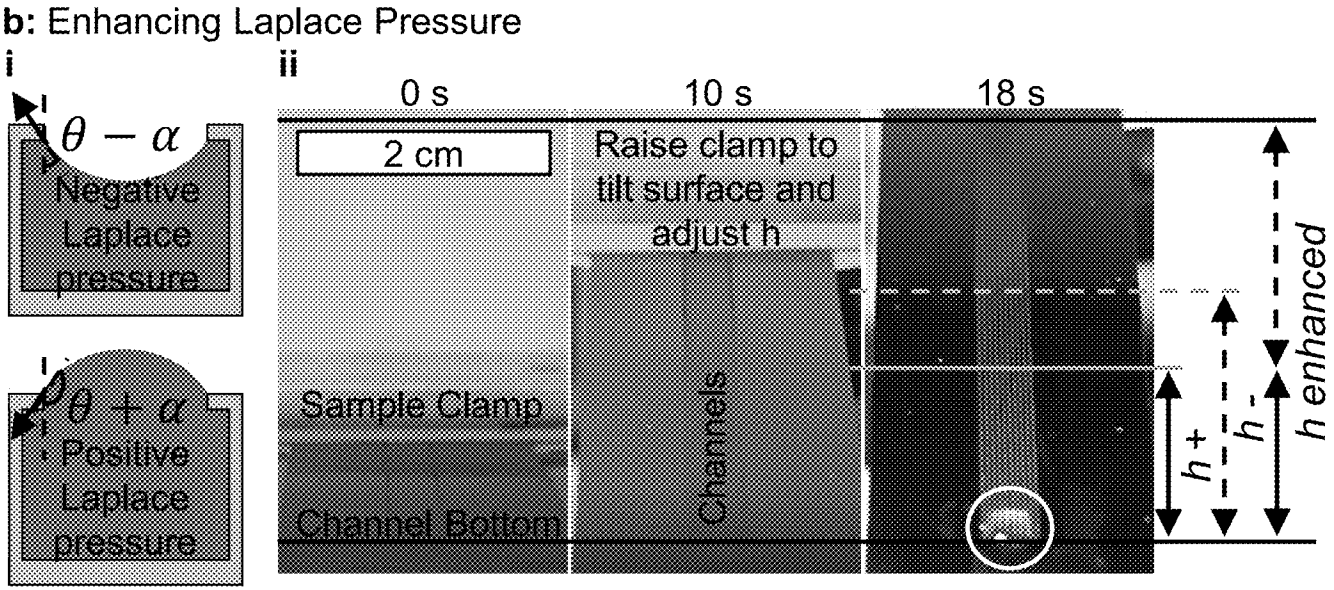
Figure 6C:
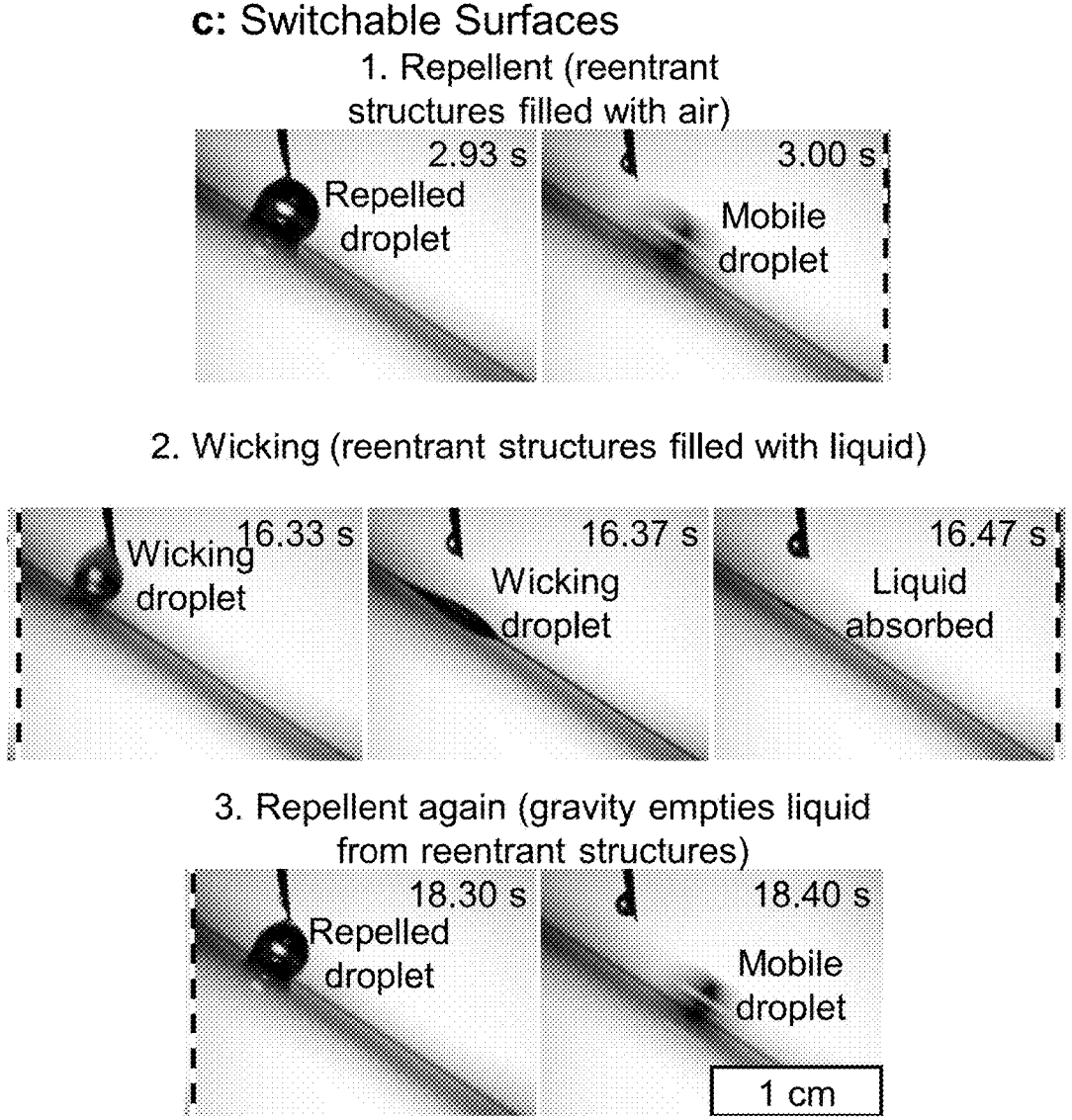

FIG. 6A-6D depict applications of omniphilic/omniphobic surfaces. FIG. 6A shows mercury filled in the channels of the reentrant surface, thus rendering that section of the surface highly wetting despite mercury's highly non-wetting intrinsic nature on the surface. The inset shows the top view of the channels at smaller magnification. FIG. 6B shows schematics of liquid in a reentrant channel. Due to the reentrant feature, the same channel can sustain both negative and positive Laplace pressures. (ii) Time-lapse images measuring the capillary height by tilting the reentrant channel surface prefilled with ethanol. The observed capillary height was greatly increased. h+ and h− are the portions of the capillary height from the positive and negative capillary pressures, respectively, and combined equal h enhanced. The white circle shows the ethanol bursting from the lower portion of the channels as the maximum capillary height was exceeded and liquid receded from the higher portion of the channels. FIG. 6C shows the surface can be switched between repelling and wicking. A tilted reentrant channel surface filled with air initially repelled liquid in the Cassie state. However, by pumping liquid into the reentrant channels a droplet placed on the surface was wicked into the channels. Finally, by removing the liquid in the channels (in this case achieved with gravity) the surface became repellent again. Images were taken from a movie. d, Wicking/repellency selectivity can be set by controlling initial wetting states. In multi-liquid systems, a reentrant surface can wick or repel either liquid. In the images, the surface was set to wick or repel both hexane and water in the presence of the other.

Figure 7A:
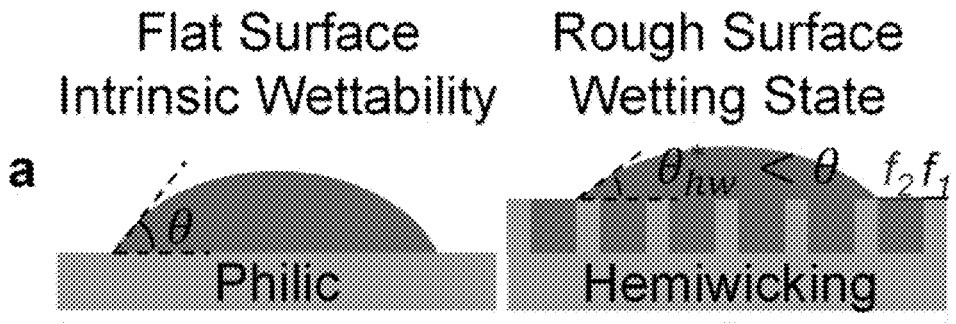
Figure 7B:
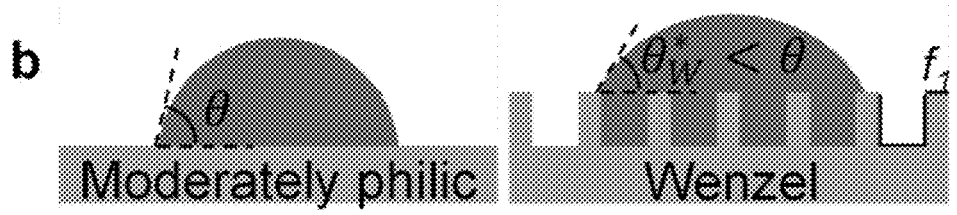
Figure 7C:
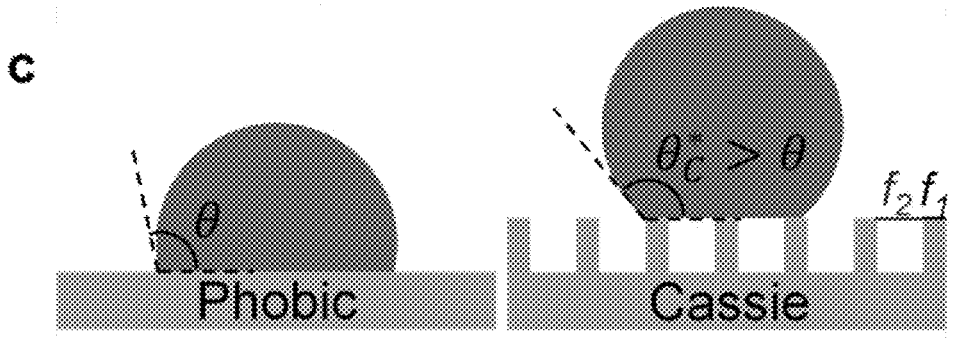

FIGS. 7A-7C depict wetting states on rough surfaces. FIG. 7A shows a liquid that is highly wetting on a flat surface spreads completely and fills a rough surface, reducing the apparent contact angle. This state is known as the hemiwicking state due to its similarity to wicking in porous media. The areal fractions of the composite interfaces, $f_1$ and $f_2$, are depicted by the black and red solid lines, respectively, for all states. FIG. 7B shows that when a moderately wetting liquid is placed on a rough surface, the liquid enters the surface roughness below the droplet but does not spread through the roughness beyond the droplet. This state is known as the Wenzel state. This state is not treated as a composite interface. As such $f_2=0$ and $f_1=r$. FIG. 7C shows that when a non-wetting liquid is placed on a rough surface, the droplet is suspended on top of the structure. This state is known as the Cassie state.

Figure 8A:
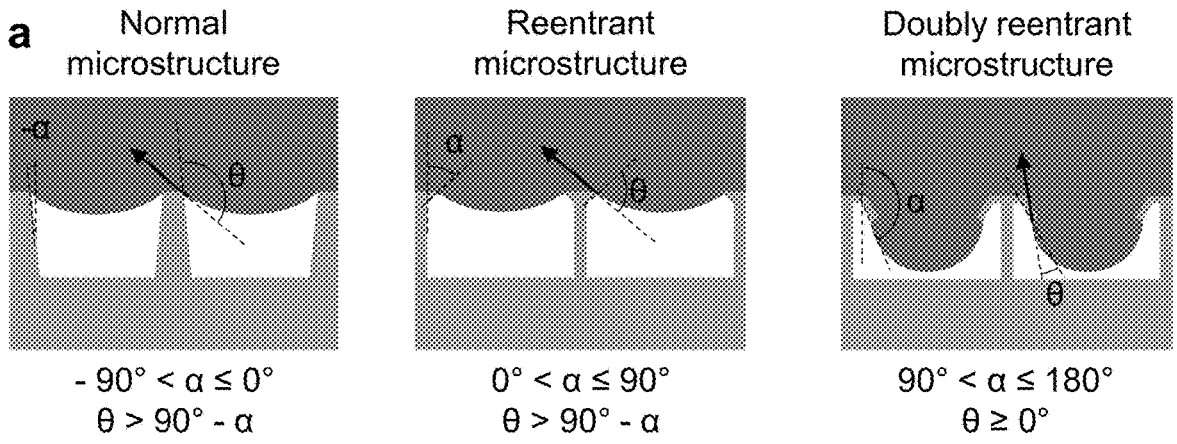
Figure 8B:
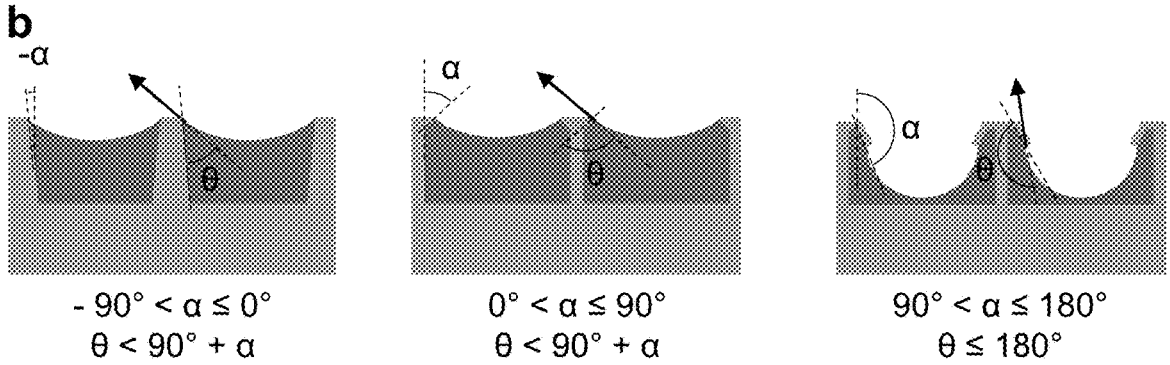

FIG. 8A-8B depict that reentrant microstructures enable omniphobic and omniphilic behavior. FIG. 8A shows that normal microstructures only repel liquids that are non-wetting ($\theta>90°$). In order to repel all liquids, i.e., omniphobic, reentrant and doubly reentrant structures are required. FIG. 8B shows that normal microstructures only wick liquids that are wetting ($\theta<90°$). In order to wick all liquids, i.e., omniphilic, reentrant and doubly reentrant structures are required.

Figure 9:
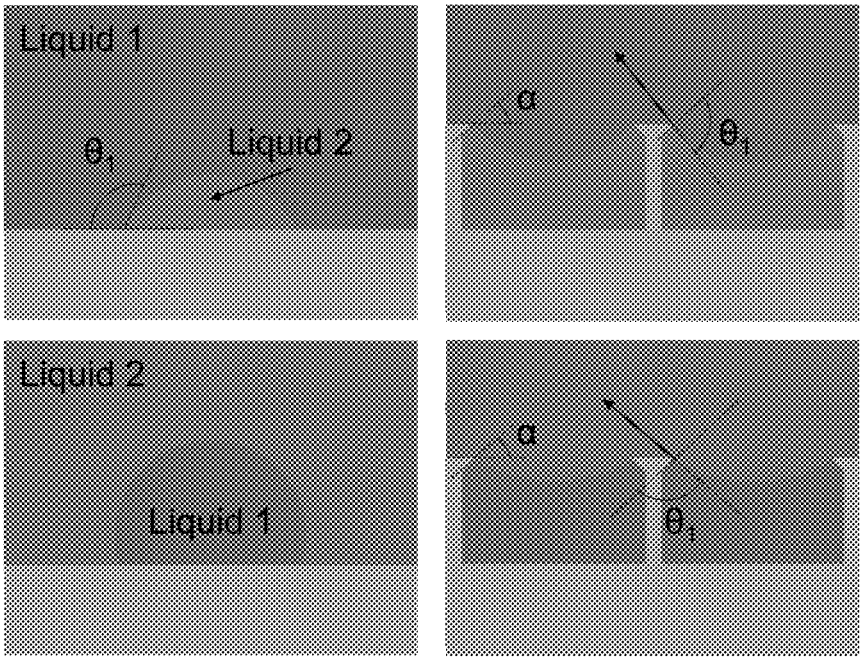

FIG. 9 depicts that reentrant microstructures can enable selectivity. Contact line pinning at the reentrant feature allows a surface in contact with two liquids to be stable (or metastable) filled with either liquid as long as $\theta_1+\alpha>90°$ and $\theta_1-\alpha<90°$, where $\theta_1$ is the contact angle liquid 1 makes with a flat surface in an environment of the second liquid. Therefore, by prefilling the surface with one liquid or the other, selective repellency or wicking of either liquid may be selected.

Figures 10A, 10B:
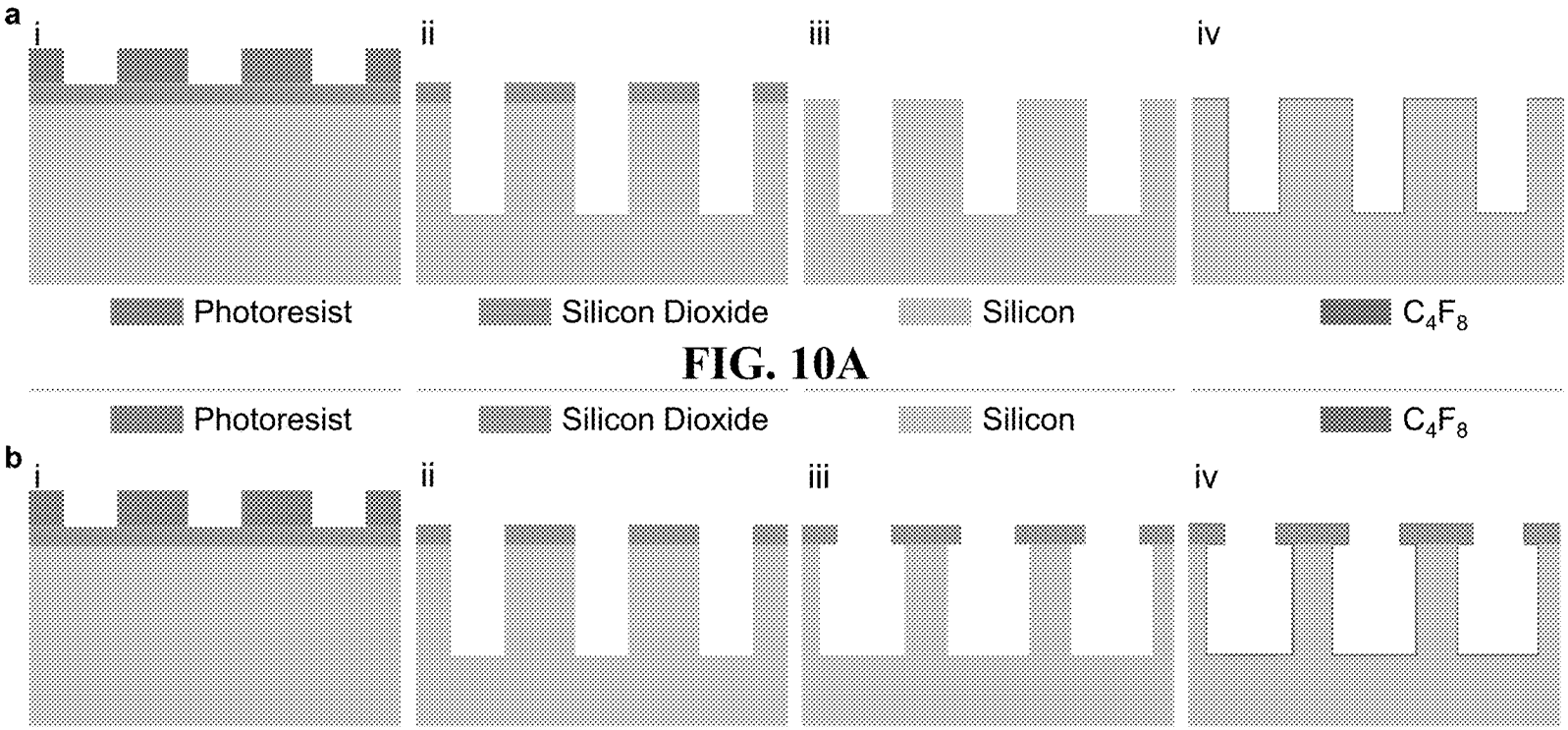

FIGS. 10A-10B depict fabrication of normal and reentrant channels. FIG. 10A shows normal channel fabrication. i. Photoresist exposure and development. ii. Reactive ion etch of the silicon dioxide and silicon to form channels. iii. Removal of oxide layer to ensure no reentrant feature was unintentionally created during reactive ion etching. iv. Deposition of a conformal hydrophobic coating to enable a range of intrinsic contact angles on the surface. FIG. 10B shows reentrant channel fabrication. i. Photoresist exposure and development. ii. Reactive ion etch of the silicon dioxide and silicon to form channels. iii. Isotropic etch of silicon to create a reentrant feature made of silicon dioxide. iv. Deposition of a conformal hydrophobic coating to enable a range of intrinsic contact angles on the surface.

Figure 11:
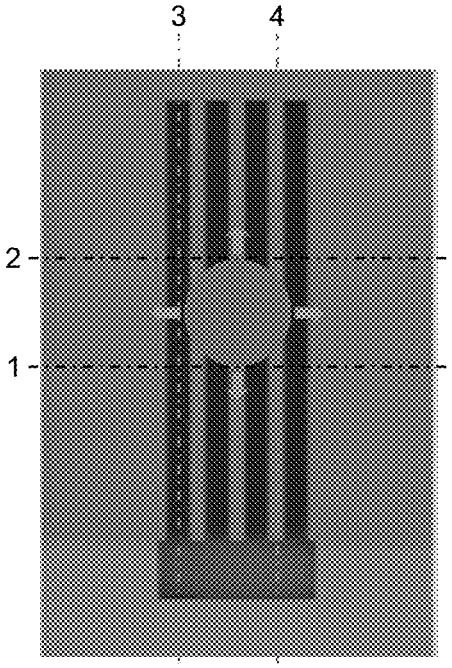

FIG. 11 depicts wetting parallel and perpendicular to channels.

Figure 12:
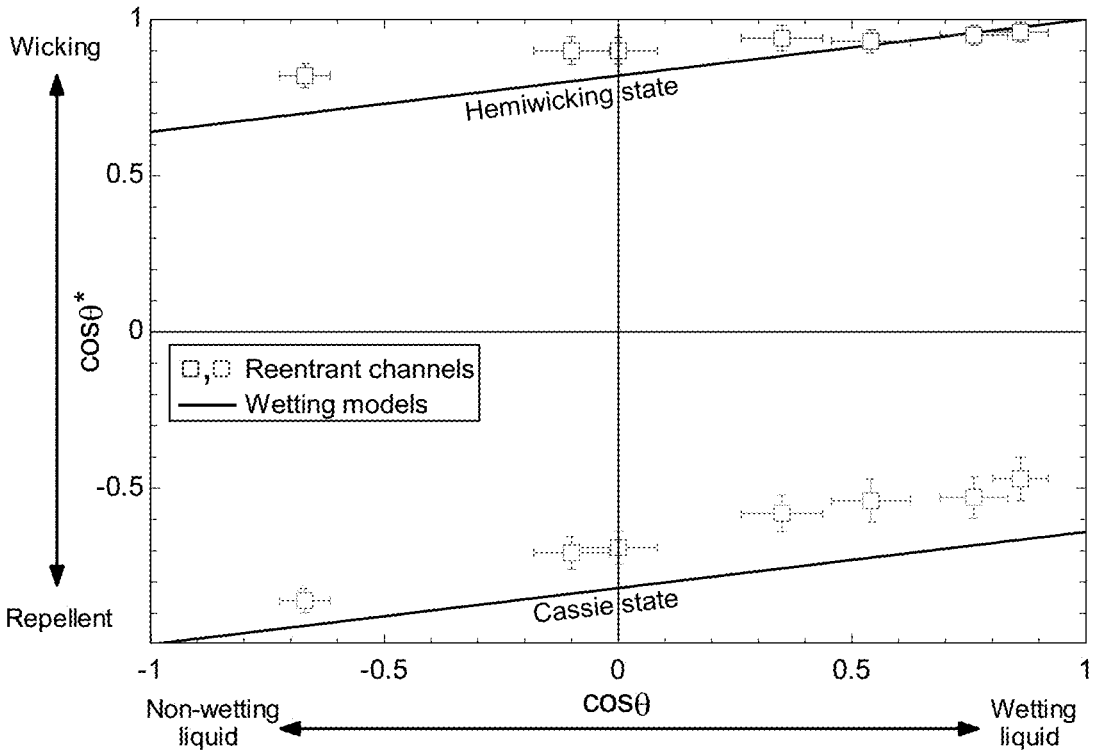

FIG. 12 depicts apparent receding contact angle measurements.

Figure 13A:
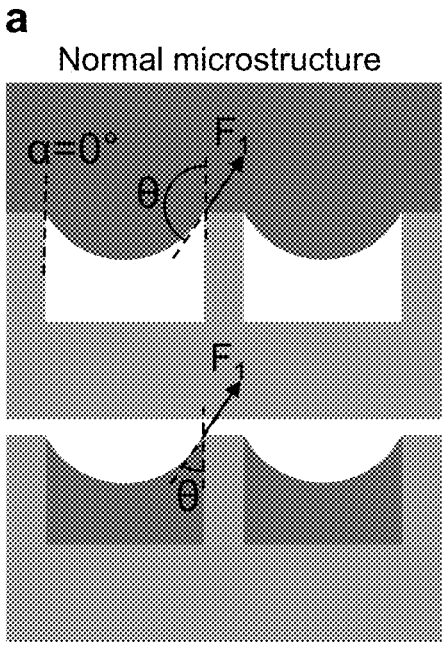
Figures 13B, 13C:
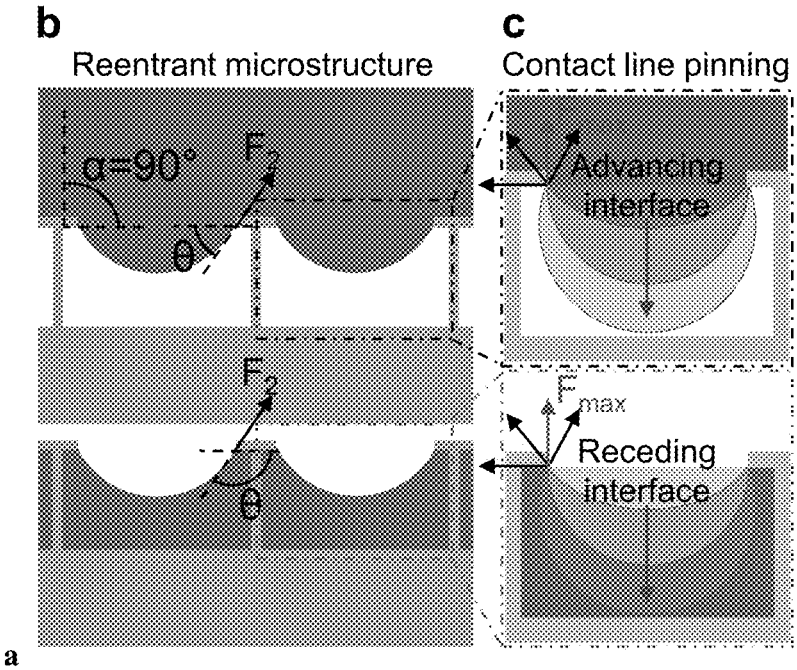

FIGS. 13A-13C depict surface tension forces for positive and negative Laplace pressures. FIG. 13A shows the surface tension force on a normal microstructure, $F_1$, that enables air to be trapped within the surface (top schematic) or enables liquid to wick up the surface when dipped into a liquid (bottom schematic). On a normal microstructure, air is trapped when $\theta>90°$ (negative capillary height) and liquid may wick up the surface when $\theta<90°$ (positive capillary height). FIG. 13B shows the surface tension force on a reentrant microstructure, $F_2$, that enables air to be trapped within the surface (top schematic) or enables liquid to remain in the structures (bottom schematic) when dipped into or pulled out of a liquid, respectively. On a reentrant microstructure with $\alpha=90°$ air is trapped when $\theta>0°$ (negative capillary height) and liquid may remain in the structure when pulled out of a liquid when $\theta<180°$ (positive capillary height). FIG. 13C shows that when $\theta+\alpha>180°$, contact line pinning at the reentrant feature causes the advancing interface of liquid being pushed into the reentrant feature to pass through a maximum for Eq. S21. Therefore, this maximum is used for capillary height estimations. Similarly, when $\theta-\alpha<0°$, the receding interface of liquid within the reentrant structure also passes through a maximum.

Figure 14:
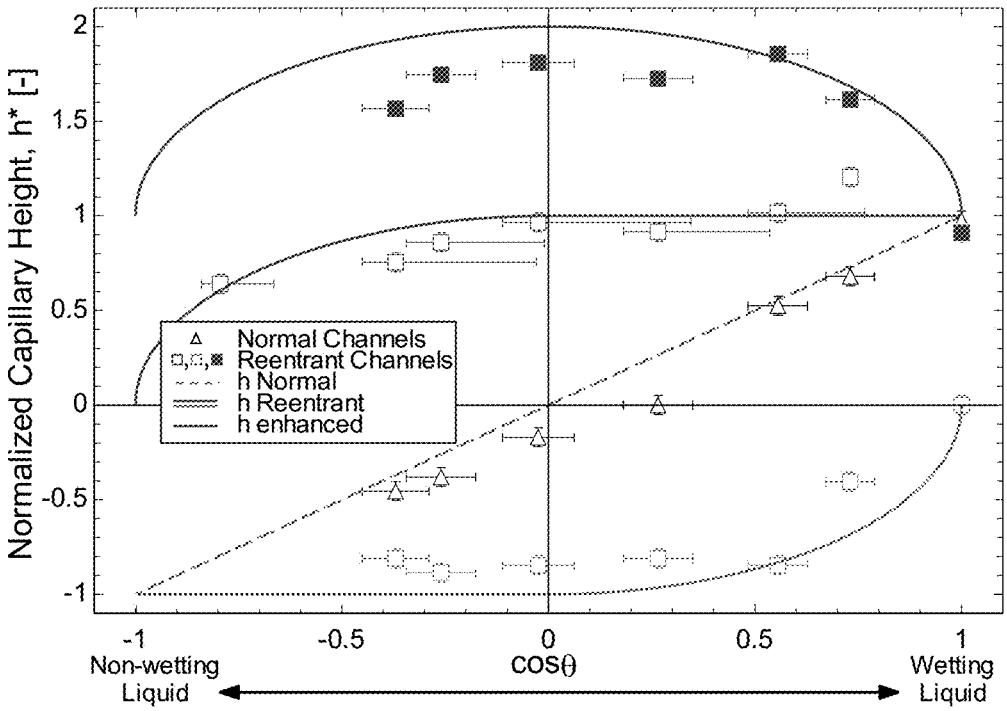

FIG. 14 depicts a graph showing an increasing the capillary height by simultaneously sustaining positive and negative Laplace pressures.

Figure 15:
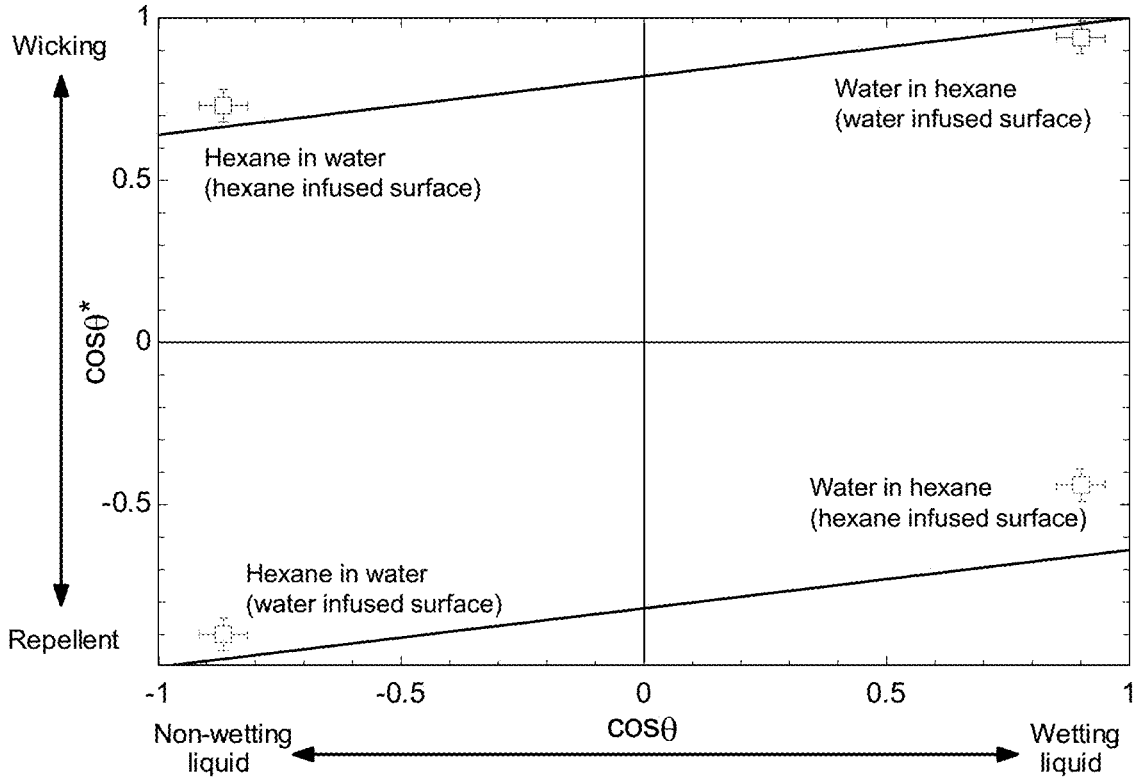

FIG. 15 depicts a graph showing selective surfaces using reentrant surfaces.

Figure 16A:
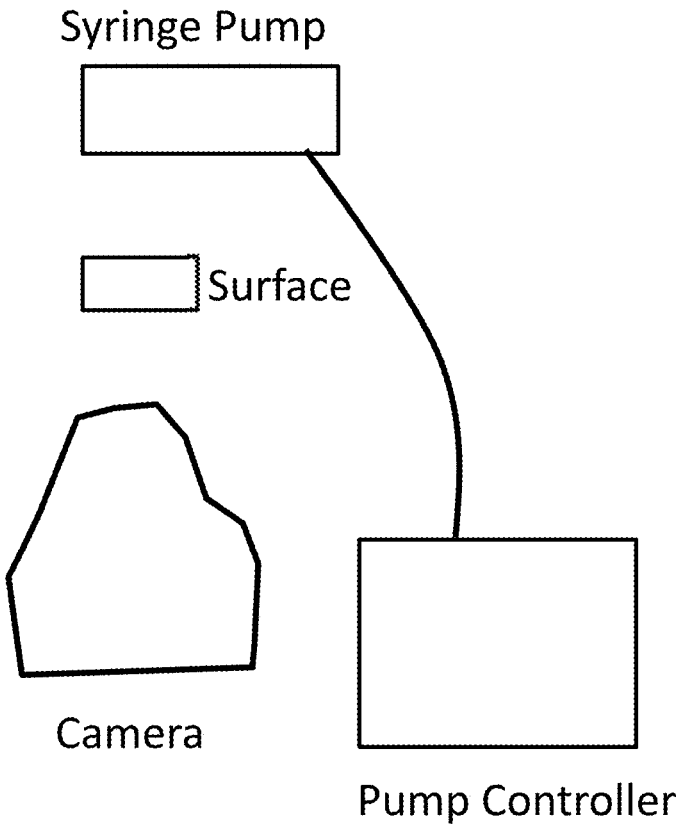
Figure 16B:
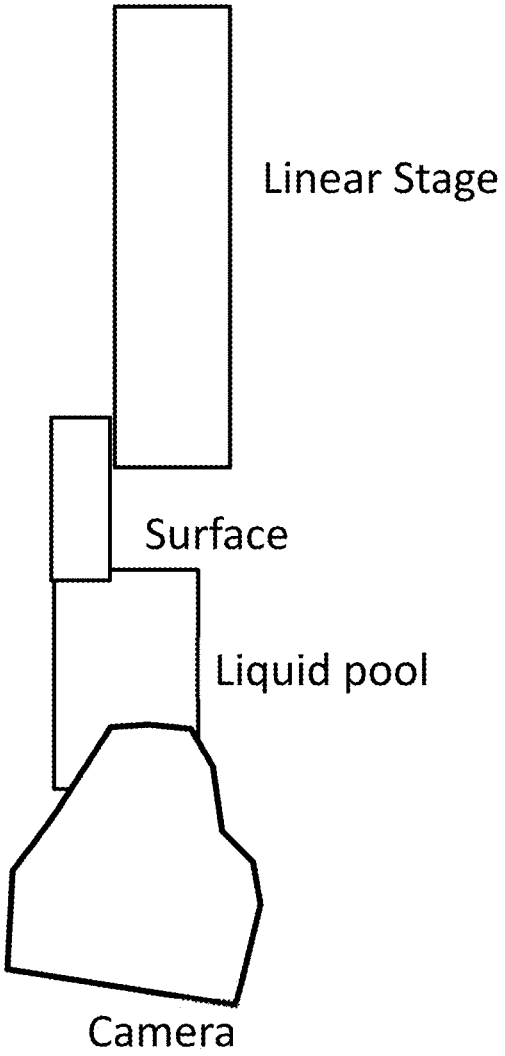

FIGS. 16A-16B depict experimental setups. FIG. 16A shows an image of the custom-built contact angle measurement setup. A syringe added and removed liquid from a droplet on the surface while a camera recorded the contact angle. A light source (not shown) provided illumination of the droplet. FIG. 16B shows an image of the custom-built capillary height measurement setup. The sample was attached to a linear stage with a Vernier scale to allow accurate measurement of the capillary height. The sample was then raised out of or lowered into a pool of liquid and the corresponding capillary height measured.

DETAILED DESCRIPTION OF THE INVENTION

Classically, liquid wetting behavior is dictated by the chemical nature of the liquid and the surface it contacts. Shifting this paradigm promises widespread, powerful functionalities. Recent progress in surface engineering has enabled repellency of completely wetting liquids using reentrant surface structures, that is, omniphobicity. For example, reentrant microstructures enabled omniphobic surfaces that repel all liquids. Similar success had not been achieved for other wetting behaviors. Here, it has been conceived and demonstrated reentrant microstructures that enabled a single surface to achieve any wetting behavior independent of surface chemistry, i.e., the surface is not only omniphobic, but also omniphilic (wicks all liquids), switchable between repelling and wicking, and selective (repels or wicks certain liquids). The same reentrant microstructures enable omniphilic surfaces that wick even high surface tension liquids such as liquid metals. The surface can be switchable between repelling and wicking, and selective where it repels or wicks only certain liquids. The reentrant microstructures create multiple stable wetting states by pinning the three-phase contact line. Therefore, all functionalities are achieved on the exact same surface by placing the surface in the corresponding stable state. A variety of applications this benefits such as wicking typically non-wetting liquids like metals, microfluidics, and liquid separation without chemical coatings are discussed below.

Figure 2:
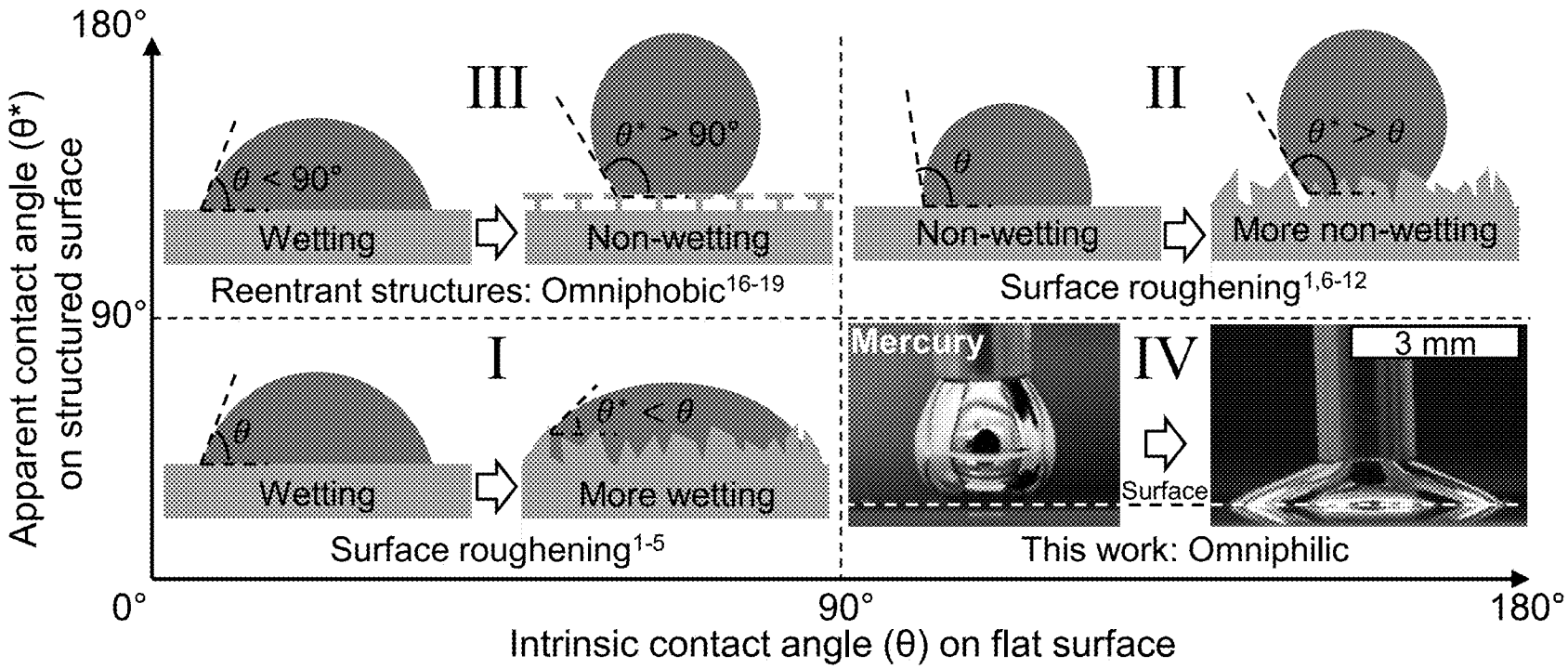
FIG. 2 is a schematic depicting wetting. When a surface that is wetting to a given liquid is roughened, it becomes more wetting such that the apparent contact angle, θ*, is less than the intrinsic contact angle, θ (Quadrant I), with liquid in either a Wenzel or hemiwicking state. Likewise, when a surface that is non-wetting to a given liquid is roughened it becomes more non-wetting such that the apparent contact angle, θ*, is greater than the intrinsic contact angle, θ (Quadrant II), with liquid in a Wenzel or Cassie state. Reentrant surfaces enabled omniphobic surfaces that maintain a repellent Cassie state even for intrinsically wetting liquids (Quadrant III). In this work, it is shown that reentrant surfaces can also enable omniphilic surfaces that wet and wick even liquids that are intrinsically highly non-wetting by maintaining the hemiwicking state (Quadrant IV). This gives reentrant surfaces functionality in all four quadrants with one design.

Surfaces that exhibit extreme liquid wetting behavior, ranging from wicking to repelling, have broad applications for various high-performance systems. Roughening of a smooth surface enables extreme liquid wetting behaviors, ranging from highly wetting/wicking to non-wetting/repelling (see below), which have broad applications for various thermofluidic systems. See, for example, Quéré, D. Wetting and roughness. Annual Review of Materials Research 38, 71-99 (2008), which is incorporated by reference in its entirety. Wicking is needed in application such as microfluidics, anti-fogging, and heat transfer enhancement via boiling and thin film evaporation, whereas repellency is needed for anti-fouling, water purification, heat transfer enhancement, drag reduction, and self-cleaning surfaces. See, for example, Comanns, P. et al. Directional, passive liquid transport: the Texas horned lizard as a model for a biomimetic 'liquid diode'. Journal of the Royal Society Interface 12, 20150415 (2015); Wang, R. et al. Light-induced amphiphilic surfaces. Nature 388, 431 (1997); Zhu, Y. et al. Prediction and characterization of dry-out heat flux in micropillar wick structures. Langmuir 32, 1920-1927 (2016); Faghri, A. Heat Pipe Science and Technology. (Global Digital Press, 1995); Leslie, D. C. et al. A bioinspired omniphobic surface coating on medical devices prevents thrombosis and biofouling. Nature Biotechnology 32, 1134-1140 (2014); Wong, T.-S. et al. Bioinspired self-repairing slippery surfaces with pressure-stable omniphobicity. Nature 477, 443-447 (2011); Lee, J., Boo, C., Ryu, W.-H., Taylor, A. D. & Elimelech, M. Development of omniphobic desalination membranes using a charged electrospun nanofiber scaffold. ACS Applied Materials & Interfaces 8, 11154-11161 (2016); Liu, T. & Kim, C.-J. in Micro Electro Mechanical Systems (MEMS), 2015 28th IEEE International Conference on. 1122-1124 (IEEE); Boreyko, J. B. & Chen, C.-H. Self-propelled dropwise condensate on superhydrophobic surfaces. Physical Review Letters 103, 184501 (2009); Choi, C.-H. & Kim, C.-J. Large slip of aqueous liquid flow over a nanoengineered superhydrophobic surface. Physical Review Letters 96, 066001 (2006); and Lu, Y. et al. Robust self-cleaning surfaces that function when exposed to either air or oil. Science 347, 1132-1135 (2015), each of which is incorporated by reference in its entirety. However, surface roughness generally only enhances the intrinsic behavior of the smooth surface[1]. A liquid that naturally wets a surface (intrinsic contact angle on a smooth surface, $\theta$, less than 90°) typically becomes more wetting with surface roughening such that the apparent contact angle of liquid on the surface, $\theta^*$, is less than $\theta$ creating wetting behavior in quadrant I of FIG. 2. In contrast, a liquid that is non-wetting on a surface ($\theta>90°$) becomes more non-wetting with surface roughening such that $\theta^*$ is greater than $\theta$, creating wetting behavior in quadrant II of FIG. 2. Because roughening tends only to enhance the intrinsic wetting behavior, this approach is limited to quadrants I and II. Chemical modification of the surface is necessary to control $\theta$ in order to achieve wicking or repellency, which is sensitive to changes in surface chemistry such as degradation or contamination. See, for example, Rose, J. Dropwise condensation theory and experiment: a review. Proceedings of the Institution of Mechanical Engineers, Part A: Journal of Power and Energy 216, 115-128 (2002); and Smith, T. The hydrophilic nature of a clean gold surface. Journal of Colloid and Interface Science 75, 51-55 (1980), each of which is incorporated by reference in its entirety. In addition, it is difficult to achieve wetting of a high-surface-energy liquid such as a liquid metal or repellency of a low-surface-energy liquid such as a fluorinated solvent. See, for example, Ellison, A. H., Klemm, R., Schwartz, A. M., Grubb, L. & Petrash, D. A. Contact angles of mercury on various surfaces and the effect of temperature. Journal of Chemical and Engineering Data 12, 607-609 (1967); and Liu, T. & Kim, C.-J. Turning a surface superrepellent even to completely wetting liquids. Science 346 (2014), each of which is incorporated by reference in its entirety. In order to render a surface repellent to wetting liquids such as low-surface-energy liquids as well, surfaces with specific reentrant microstructures have been used (FIG. 8A), opening up wetting behavior in quadrant III of FIG. 2. See, for example, Liu, T. & Kim, C.-J. Turning a surface superrepellent even to completely wetting liquids. Science 346 (2014); Tuteja, A. et al. Designing superoleophobic surfaces. Science 318, 1618-1622 (2007); Wilke, K. L., Preston, D. J., Lu, Z. & Wang, E. N. Toward condensation-resistant omniphobic surfaces. ACS nano 12, 11013-11021 (2018); and Ahuja, A. et al. Nanonails: A simple geometrical approach to electrically tunable superlyophobic surfaces. Langmuir 24, 9-14 (2008), which is incorporated by reference in its entirety. By using doubly reentrant microstructures, this approach enabled an unprecedented ability for any surface material to be omniphobic and repel all liquids.

However, similar success had not yet been achieved in quadrant IV, taking non-wetting liquid/material combinations and rendering them highly wetting. Reentrant surface structures also enable omniphilicity, i.e., wetting all liquids including non-wetting liquids (FIG. 8B). Control over the wetting state of the reentrant surface dictates its behavior as repellent or wicking, opening up the possibility for wetting behavior in all four quadrants. Accordingly, this work shows the ability to control wetting through surface structuring alone, decoupling the wetting behavior from the material/liquid used. This flexibility has potential value in systems where required wetting behavior limits design to non-optimal materials and liquids. Furthermore, because the wetting behavior of reentrant surfaces can be controlled, more complex wetting functionalities are possible. For example, these surfaces can be actively switched between the wicking and repellent states, creating surfaces where wetting behavior is controlled between both wetting extremes. Selective wicking and repellency, i.e., the ability to wick certain liquids while repelling others (FIG. 9). These functionalities, which are desirable for liquid separation, microfluidics, and microrobotics, would otherwise require complex chemical modification of the surface specific to the liquids for which switchability or selectivity is desired. See, for example, Yang, J. et al. Superhydrophilic-superoleophobic coatings. *Journal of Materials Chemistry* 22, 2834-2837 (2012); Feng, L. et al. A super-hydrophobic and super-oleophilic coating mesh film for the separation of oil and water. *Angewandte Chemie* 116, 2046-2048 (2004); Krupenkin, T. N., Taylor, J. A., Schneider, T. M. & Yang, S. From rolling ball to complete wetting: the dynamic tuning of liquids on nanostructured surfaces. *Langmuir* 20, 3824-3827 (2004); Chen, Y., Doshi, N., Goldberg, B., Wang, H. & Wood, R. J. Controllable water surface to underwater transition through electrowetting in a hybrid terrestrial-aquatic microrobot. *Nature Communications* 9, 2495 (2018); Kwon, G., Post, E. & Tuteja, A. Membranes with selective wettability for the separation of oil-water mixtures. *MRS Communications* 5, 475-494 (2015); Kavousanakis, M. E. et al. How to achieve reversible electrowetting on superhydrophobic surfaces. *Langmuir* 34, 4173-4179 (2018); Li, J.-J., Zhou, Y.-N. & Luo, Z.-H. Polymeric materials with switchable superwettability for controllable oil/water separation: a comprehensive review. *Progress in Polymer Science* (2018), each of which is incorporated by reference in its entirety.

Figure 3A:
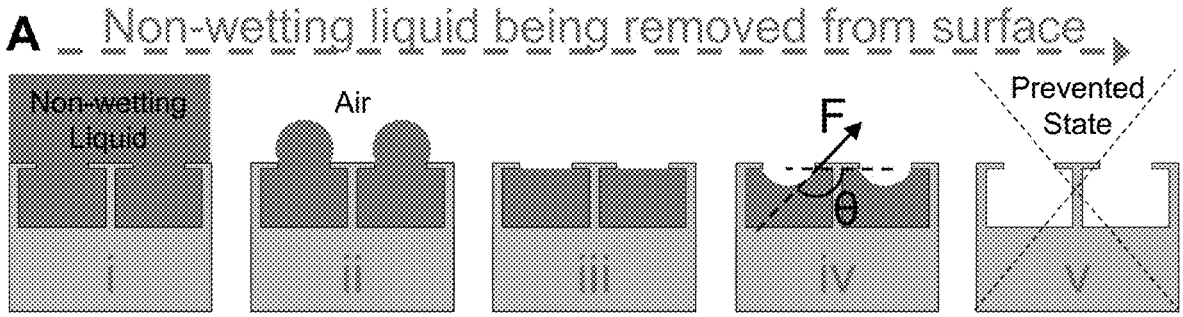
FIGS. 3A-3C depict wetting of a bistable surface, which has the ability to both repel and wick all liquids.
Figure 3B:
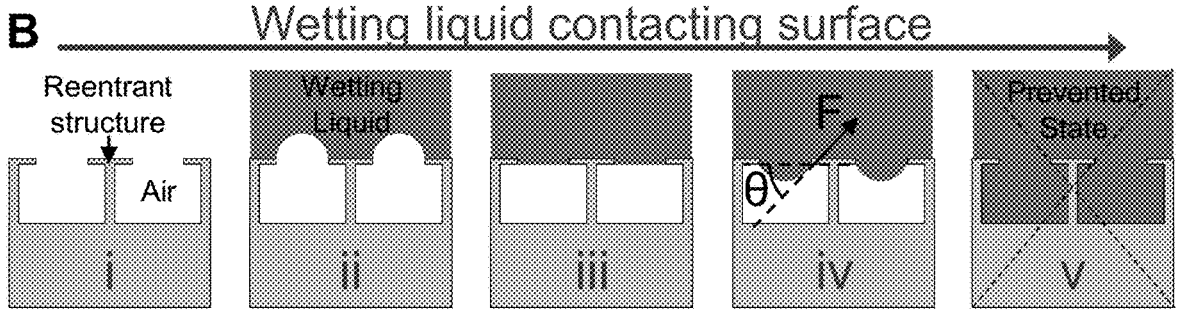

When reentrant microstructures start in a liquid-filled state (FIG. 3A i), contact line pinning occurs at the reentrant feature as the liquid is removed from the surface (FIG. 3A ii and iii). This creates a surface tension force, F, that keeps even a non-wetting liquid within the structure (FIG. 3A iv, which depicts a non-wetting liquid with $\theta=135°$), avoiding a completely dry state (FIG. 3A v). Conceptually, this is similar to previous studies that have shown reentrant structures enable repellency of wetting liquids. See, for example, Liu, T. & Kim, C.-J. Turning a surface superrepellent even to completely wetting liquids. *Science* 346 (2014); Tuteja, A. et al. Designing superoleophobic surfaces. *Science* 318, 1618-1622 (2007); Wilke, K. L., Preston, D. J., Lu, Z. & Wang, E. N. Toward condensation-resistant omniphobic surfaces. *ACS nano* 12, 11013-11021 (2018); Ahuja, A. et al. Nanonails: A simple geometrical approach to electrically tunable superlyophobic surfaces. *Langmuir* 24, 9-14 (2008); and Yang, J. et al. Superhydrophilic-superoleophobic coatings. *Journal of Materials Chemistry* 22, 2834-2837 (2012), each of which is incorporated by reference in its entirety. As a wetting liquid comes into contact with a reentrant microstructure initially filled with air (FIG. 3B i-FIG. 3B ii), the three-phase contact line of the liquid pins at the reentrant feature (FIG. 3B iii), producing a surface tension force that prevents liquid from entering the structure even for intrinsically wetting liquids (FIG. 3B iv, which depicts a wetting liquid with $\theta=45°$), thereby avoiding a completely filled state (FIG. 3B v). Therefore, reentrant structures create bistable surfaces (surfaces with two stable states), where a local energy minimum enables both wicking and repellency independent of the intrinsic wettability of the liquid/surface used (FIG. 3C and see below for a description of modeling the surface energy). In other words, control over the wetting state of the reentrant surface dictates its behavior as repellent or wicking, with a local energy minimum in FIG. 3C for each quadrant of FIG. 2.

Figure 1:
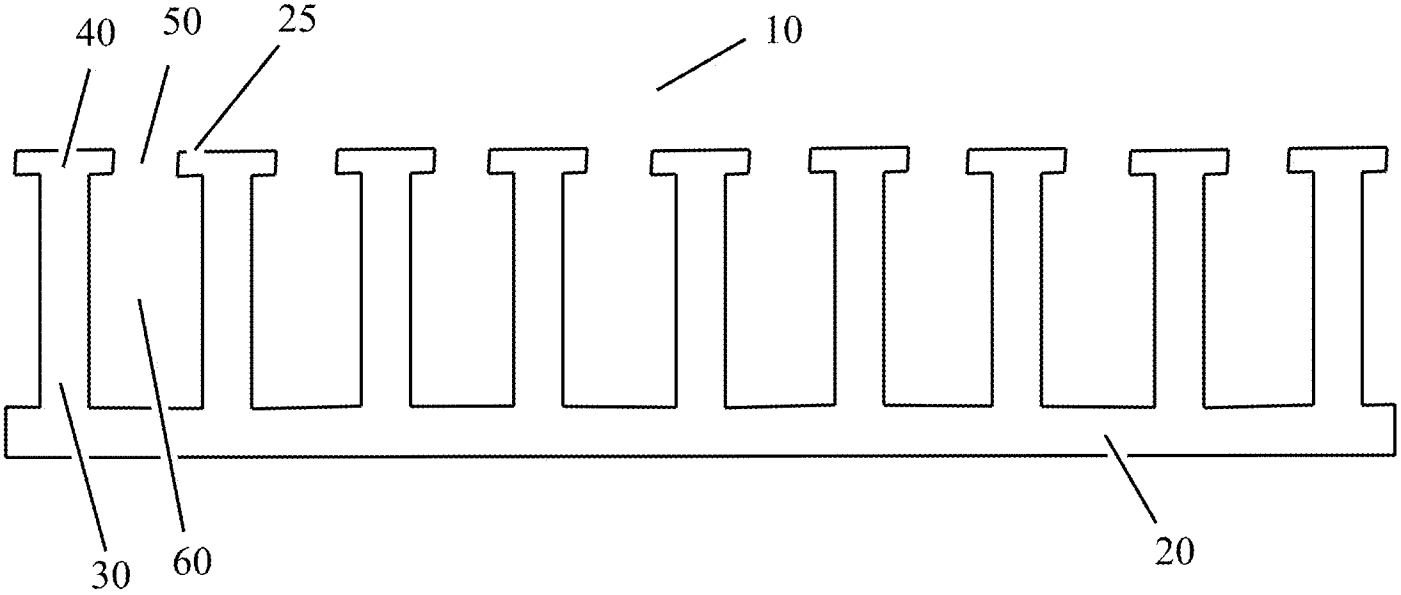
FIG. 1 shows a surface as described herein.

Referring to FIG. 1, a selective wetting surface 10 on substrate 20 can include a reentrant structure 40 (or a plurality of reentrant structures) on a surface 25 having a bistable surface. The bistable surface can have two stable states. The reentrant structure can have negative curvature relative to the space adjacent that portion of the surface. The surface can include a plurality of reentrant structures 40 that are spaced by gap 50 to create channel 60 (shown in cross-section).

The surface can be omniphobic or omniphilic or selectively repelling or wicking. A selectively repelling or wicking surface can be a surface that wicks or repels one liquid in the presence of another liquid without the need for complex chemical coatings.

The surface can be on a substrate. The substrate can be a glass, metal, inorganic polymer, semiconductor, a ceramic, an organic polymer or other structure. The surface can be coated or uncoated, for example, with a polar coating or an non-polar coating. The coating can be a polymer coating, a coating of organic material, or an inorganic coating. For example, the coating can include an acrylic polymer, a polyolefin, a fluorinated polymer, a siloxane, an organic molecule, silicon dioxide, aluminum oxide, or the combinations thereof.

The surface can be switchable between repelling, wicking or selective. When the surface includes a structure, such as a reentrant structure or microchannels, a liquid can be added, for example via pumping, into the structure to alter the surface behavior to be repelling, wicking or selective. The liquid can be selected to confer the desired property of the surface. For example, the liquid can be a polar liquid, a non-polar liquid, a protic liquid, an aprotic liquid, a hydrocarbon, an alcohol, a liquid metal, or a combination thereof. The structure can be filled with a non-wetting liquid. In other circumstances, the structure can be filled with a wetting liquid.

By adjusting the structure of the surface and introducing liquid into the structure, the selective wetting surface can repel or wick a particular liquid or set of liquids.

The reentrant structure can be a micronails, have an T shaped cross-section, have an inverted L shaped cross-section or can be a reverse micronail, in which the base is broader than the top, and the top has a re-entrant portion on the surface. The reentrant structure can be spaced periodically, for example, in square or hexagonal patterns, can form channels or microchannels, or a combination thereof. The spacing between microstructures and height can be selected to avoid liquid contact with the substrate upon with the microstructures are built. In certain circumstances, the reentrant structure can have a negative curvature relative to the space between microstructures. In an alternative method of forming the microstructures, a material can be used as a template or porophore to create microstructures on a surface of a substrate. The microstructures can be patterned in a periodic or aperiodic manner.

The reentrant structure can have an overhang or can be a doubly reentrant structure. The reentrant structure can include a plurality of microstructures. The microstructures can be pillars, pins, walls, channels, or cavities. The microstructures can have dimensions of 0.005 to 500 microns, for example, 0.010 to 400 microns, 0.05 to 300 microns, 0.1 to 200 microns, or 0.2 to 100 microns. The microstructures can form a pattern. The spacing between the microstructures can be between 0.01 to 1000 microns, for example, 0.05 to 600 microns, 0.1 to 500 microns or 0.2 to 250 microns. For example, the spacing can be 0.1 to 10 microns.

The reentrant structure can include microchannels. The microchannels can be straight or curved. The microchannels can be have a reentrant portion having a width of 00.005 to 500 microns, for example, 0.010 to 400 microns, 0.05 to 300 microns, 0.1 to 200 microns, or 0.2 to 100 microns. The spacing between the microchannels can be between 0.01 to 1000 microns, for example, 0.05 to 600 microns, 0.1 to 500 microns or 0.2 to 250 microns. For example, the spacing can be 0.1 to 10 microns.

A pump can deliver a liquid to the reentrant structure.

The surface properties can be switched. For example, a method of switching a wetting characteristic of a surface can include providing a surface including a reentrant structure on the surface having a bistable surface, and selecting the wetting characteristic of the surface to be omniphobic or omniphilic or selectively repelling or wicking, wherein the surface is switchable between repelling, wicking or selective.

In certain embodiments, selecting the wetting characteristic includes placing a liquid in the reentrant structure. In other embodiments, the method can include removing a liquid from the reentrant structure.

Fabricated Reentrant Microstructures

Figures 4A, 4B:
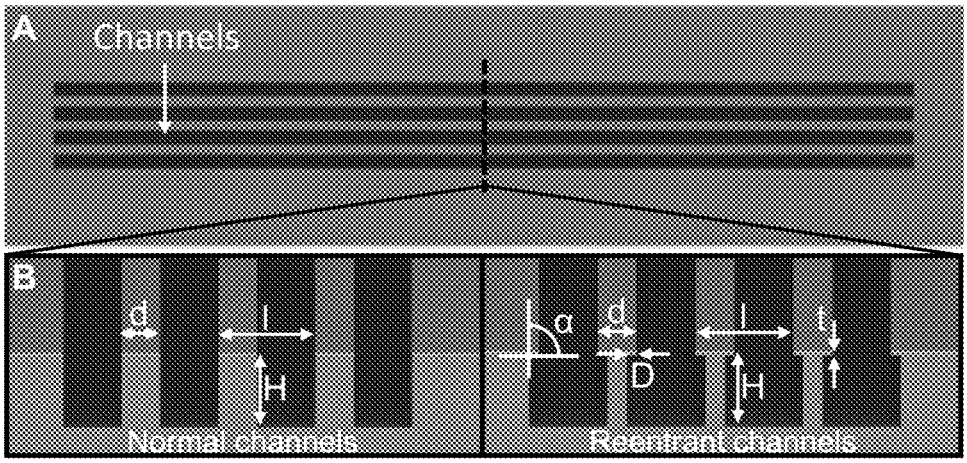
FIGS. 4A-4E depict omniphilic and omniphobic behaviors.
Figure 4C:
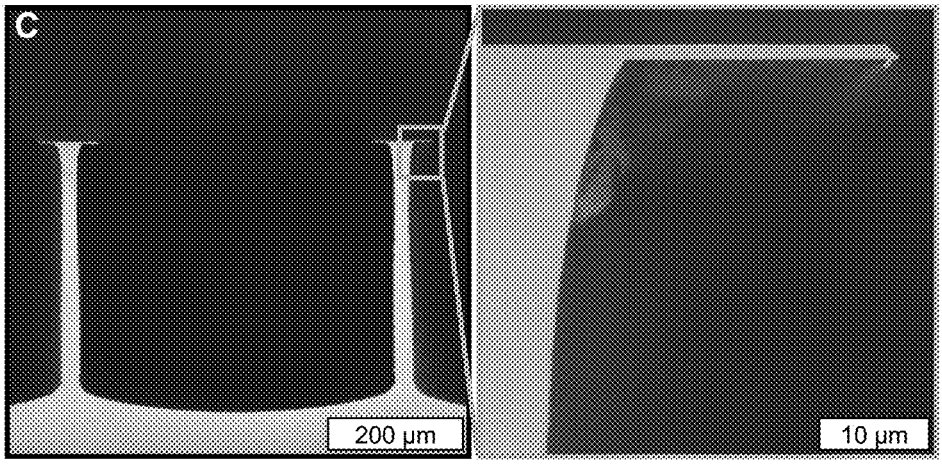

To experimentally demonstrate that reentrant structures enable repellency, wicking, switchability, and selectivity with a single surface design, normal microchannels (no reentrant feature) and reentrant microchannels were fabricated (FIG. 4A). Channels were chosen due to the simplicity of fabrication and the well-established understanding of typical wetting behavior. See, for example, Choi, W., Tuteja, A., Mabry, J. M., Cohen, R. E. & McKinley, G. H. A modified Cassie-Baxter relationship to explain contact angle hysteresis and anisotropy on non-wetting textured surfaces. *Journal of Colloid and Interface Science* 339, 208-216 (2009), which is incorporated by reference in its entirety. The normal channels were fabricated in silicon (FIG. 10A) and had channel walls of width d, height H, and pitch l. The reentrant channels were fabricated in silicon with a silicon dioxide reentrant overhang (FIG. 10B) of thickness t, length D, and reentrance angle $\alpha$ (FIG. 4B). Surfaces with l=500 μm, H≈400 μm, d=90 μm, t=1 μm, D=25 μm, and $\alpha$=90° (typical sample cross section in FIG. 10C) were fabricated. As an example, reentrant microstructures were selected to exemplify the innovation as opposed to doubly reentrant structures given fabrication is less complex and most liquids do not exhibit an intrinsic contact angle of 180°. Therefore, doubly reentrant structures are not required to demonstrate the predicted wetting behavior (FIG. 8B). Table 1 summarizes the geometry of tested samples. Before testing, unless otherwise stated, the surfaces were coated with a conformal, 60 nm thick, low-surface-energy polymer ($C_4F_8$) to create a uniform and repeatable contact angle across different tested surfaces, but the coating is not required for the functionalities that are demonstrated. In fact, the coating generally renders the surface more repellent, making a demonstration of omniphilicity more difficult.

Apparent Wettability Independent of Intrinsic Wettability

First, in contrast to normal channels, reentrant microstructures enable both omniphilicity and omniphobicity. In this experiment, the apparent contact angle (cos $\theta^*$) was measured for a variety of liquids with different intrinsic contact angles (cos $\theta$) ranging from highly wetting to highly non-wetting (liquid properties listed in Table 2). A syringe was used to add and remove a droplet from the surface, while a camera recorded the apparent contact angle as the droplet's three-phase contact line advanced and receded parallel to the channels (see below and FIG. 11 for more information on wetting on channels). For brevity, the contact angle measurement while the droplet was advancing (liquid being added to droplet), however, similar trends were observed for the receding contact angle measurement (liquid being removed from the droplet, FIG. 11). When liquid comes into contact with a microstructured surfaces, three distinct wetting states occur. First is the wicking state, which typically only occurs for highly wetting liquids, called the hemiwicking state. See, for example, Dettre, R. & Johnson, R. Contact angle hysteresis, I. Study of an idealized rough surface. *Advances in Chemistry Series* 43, 112 (1964), which is incorporated by reference in its entirety. In this state, liquid completely fills the microstructure (FIG. 7A). Second is an intermediate state that occurs for moderately wetting liquids, called the Wenzel state. See, for example, Wenzel, R. N. Resistance of solid surfaces to wetting by water. *Industrial & Engineering Chemistry* 28, 988-994 (1936), which is incorporated by reference in its entirety. In the Wenzel state, liquid only fills the structure below the droplet (FIG. 7B). Third is the repellent state which typically only occurs for non-wetting liquids, called the Cassie state. See, for example, Cassie, A. & Baxter, S. Wettability of porous surfaces. *Transactions of the Faraday society* 40, 546-551 (1944), which is incorporated by reference in its entirety. In the Cassie state, air is trapped in the structures below the droplet (FIG. 7C). Further discussion on these wetting states, their governing equations, and when they occur may be found in below.

Figure 4D:
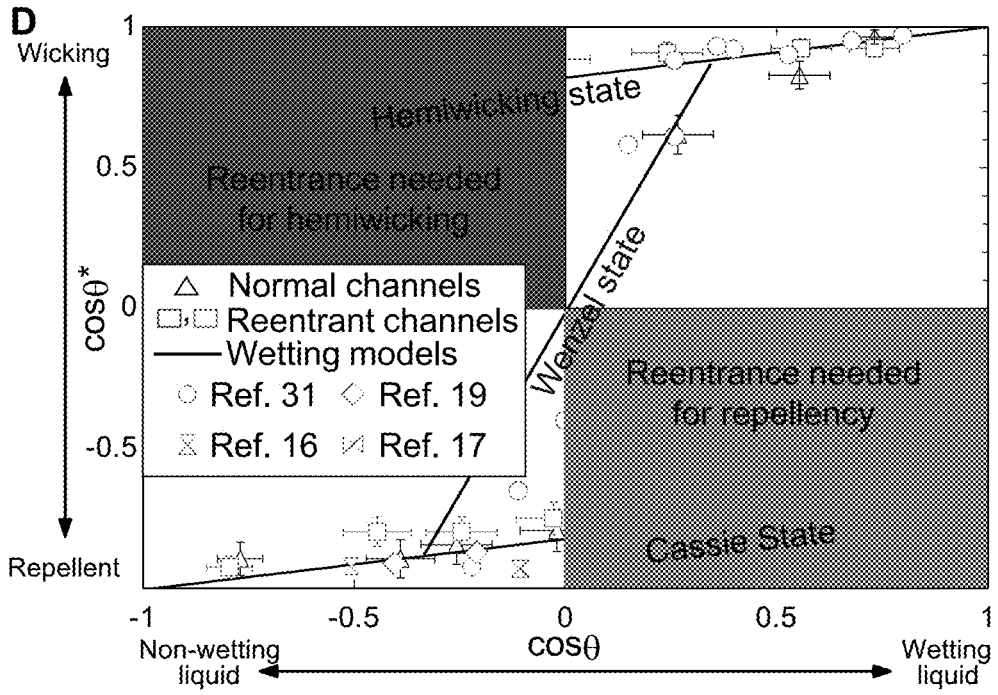
Figure 4E:
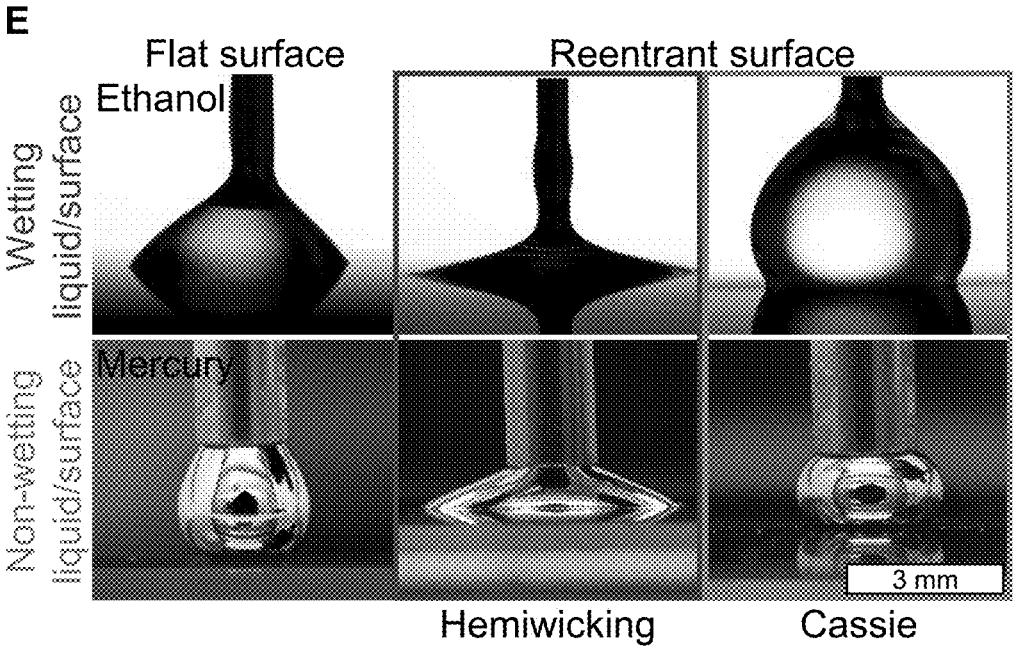

The normal channels (black triangles in FIG. 4D) highlighted typical wetting behavior where highly wetting liquids formed the hemiwicking state, moderately wetting liquids formed the Wenzel state, and non-wetting liquids formed the Cassie state, consistent with previous literature. See, for example, Quéré, D. Wetting and roughness. *Annual Review of Materials Research* 38, 71-99 (2008); and Shibuichi, S., Onda, T., Satoh, N. & Tsujii, K. Super water-repellent surfaces resulting from fractal structure. *The Journal of Physical Chemistry* 100, 19512-19517 (1996), each of which is incorporated by reference in its entirety. Note that the Cassie state was observed at contact angles less than the critical angle due to a commonly observed metastable Cassie state. See, for example, Lafuma, A. & Quéré, D. Superhydrophobic states. Nature Materials 2, 457-460 (2003), which is incorporated by reference in its entirety. Reentrant channels, on the other hand, allowed the Cassie state to be extended to wetting liquids (area shaded in red indicates region that requires reentrant geometry for repellency) by trapping air within the channels (red squares), consistent with previous studies. Therefore, $\theta^*$ was determined by Eq. S3 and the surface was repellent for all liquids, hence achieving omniphobic behavior consistent with previous research (not all data follows the model prediction due to differences in the solid fraction of surfaces used in each work). See, for example, Liu, T. & Kim, C.-J. Turning a surface superrepellent even to completely wetting liquids. *Science* 346 (2014); Tuteja, A. et al. Designing superoleophobic surfaces. *Science* 318, 1618-1622 (2007); and Ahuja, A. et al. Nanonails: A simple geometrical approach to electrically tunable superlyophobic surfaces. *Langmuir* 24, 9-14 (2008), which is incorporated by reference in its entirety. However, it is also shown that by first filling the reentrant channels with the same liquid as that in the syringe, i.e., placing the surface into a stable wicking state, the hemiwicking state was also extended to non-wetting liquids (blue squares, area shaded in blue indicates region that requires reentrant geometry for hemiwicking). As such, Eq. S2 governed the wetting behavior and a small apparent contact angle was achieved for all liquids regardless of intrinsic contact angle (omniphilic behavior), although it is noted that because the surface requires prefilling, this is different than the traditional hemiwicking state where liquid spontaneously fills the surface. Counterintuitively, the exact same surface was able to exhibit both omniphobic and omniphilic behavior. Therefore, a liquid such as ethanol that is typically wetting on a flat surface can have both wicking and repellent behavior on a reentrant surface. Similarly, a typically highly non-wetting liquid such as mercury may also have both wicking and repellent behavior (FIG. 3E).

Supporting Positive and Negative Laplace Pressures on the Same Surface

The reason for this contradictory wetting behavior is the reentrant surface's unique ability to sustain both positive and negative Laplace pressures, $P_L$, independent of the liquid's intrinsic contact angle (FIG. 5A). It is possible to quantify this pressure by measuring the capillary height of the surface, which is determined by a balance of the Laplace pressure and the hydrostatic pressure as:

$$h = \frac{2\gamma\cos(\theta \pm \alpha)}{(l-d)\Delta\rho g} \tag{1}$$

where $\gamma$ is the liquid surface tension, $\Delta\rho$ is the density difference between the liquid and air, and g is the gravitational acceleration. $\cos(\theta+\alpha)$ is used for the Cassie state, whereas $\cos(\theta-\alpha)$ is for the hemiwicking state (FIG. 4*a*). Furthermore, due to pinning of the three-phase contact line causing the interface to pass through maxima/minima of cosine (FIGS. 13A-13C), when $\theta-\alpha<0°$, $\theta-\alpha=0°$ is used, and when $\theta+\alpha>180°$, $\theta+\alpha=180°$ is used. See below for a derivation and further explanation. A normalized capillary height, h*, is then calculated to account for the surface geometry and different properties of liquids used as:

$$h^* = \frac{h((l-d)\Delta\rho g)}{2\gamma} = \cos(\theta \pm \alpha) \tag{2}$$

A surface without reentrance ($\alpha=0°$) has a positive capillary height for wetting liquids and a negative capillary height for non-wetting liquids, a behavior which was captured by the normal channels (black triangles in FIG. 5B). When the surface was dipped into a pool of wetting liquid it exhibited hemiwicking, where the liquid rose up in the channels a given height due to the negative Laplace pressure counteracting gravity. In contrast, when a non-wetting liquid was used, air was trapped within the surface down to a given depth in the liquid due to the positive Laplace pressure. However, adding reentrance ($\alpha=90$) allowed both negative (red squares) and positive (blue squares) capillary heights for all liquids simply by controlling the initial wetting state. The error bars for the positive capillary height reentrant surface were larger to account for the receding contact angle governing the capillary height as opposed to the advancing contact angle (see below for method of uncertainty propagation). When a reentrant channel prefilled with liquid, i.e., in the hemiwicking state, was raised out of the liquid (FIG. 5C, which shows a liquid with $\theta=91.6°$), liquid remained trapped within the structures. At a given height, the maximum sustainable capillary height was exceeded and the liquid dewet from the reentrant channels. Likewise, when a reentrant channel filled with air was lowered into the same liquid (FIG. 5D), air remained trapped within the structures. At a given depth into the liquid, the maximum negative capillary height was exceeded and the liquid entered the reentrant structures.

Further Applications of Bistable Wetting Surfaces: Material Independent Design

The measurements of apparent contact angle and capillary height highlight that reentrant surfaces enable stable states for both wicking and repellency of all liquids on the exact same surface independent of intrinsic wettability. This omniphilic/omniphobic duality can be utilized to enhance current technologies and also enables a number of unique wetting functionalities. First, the ability to achieve wicking and repellency independent of the intrinsic wettability of the surface material, as presented in this work, broadens the potential materials used for many applications that utilize tailored wetting. For example, a surface/liquid combination that is typically non-wetting can be now be made highly wetting and wicking, such as water on low-surface-energy materials or liquid metals on most materials (FIG. 6A shows mercury highly wetting on the reentrant surface). This ability could be useful in many scenarios, such as high temperature heat pipes, metal processing, and emerging energy systems, which use liquid/surface combinations that are often non-wetting but could benefit greatly from wetting or wicking. See, for example, Faghri, A. *Heat Pipe Science and Technology*. (Global Digital Press, 1995); and Weirauch, D. Interfacial phenomena involving liquid metals and solid oxides in the Mg—Al—O system. *Journal of Materials Research* 3, 729-739 (1988), each of which is incorporated by reference in its entirety. For example, ceramic materials must be used in high temperature heat pipes due to their temperature stability, however, these ceramics are generally non-wetting, and therefore non-wicking to liquid metals. Similarly, a surface can be made repellent to typically wetting liquids, which is useful in chemical processing, anti-corrosion, and phase-change heat transfer. See, for example, Pan, S., Kota, A. K., Mabry, J. M. & Tuteja, A. Superomniphobic surfaces for effective chemical shielding. *Journal of the American Chemical Society* 135, 578-581 (2012); and Liu, T. & Kim, C.-J. in *Micro Electro Mechanical Systems* (*MEMS*), 2015 28*th IEEE International Conference on.* 1122-1124 (IEEE), each of which is incorporated by reference in its entirety. Finally, because the wetting behavior can be made independent of the intrinsic wettability, wicking or repellent systems that are robust to changes in intrinsic wettability due to surface contamination or degradation are also possible, both of which commonly occur in systems that rely on chemical modification to tailor wetting. See, for example, Rose, J. Dropwise condensation theory and experiment: a review. *Proceedings of the Institution of Mechanical Engineers, Part A: Journal of Power*

*and Energy* 216, 115-128 (2002); and Smith, T. The hydrophilic nature of a clean gold surface. *Journal of Colloid and Interface Science* 75, 51-55 (1980), each of which is incorporated by reference in its entirety.

Further Applications of Bistable Wetting Surfaces: Doubling the Laplace Pressure Furthermore, a filled reentrant channel can support both positive and negative Laplace pressures (FIG. 6B i). In fact, the reentrant channels can simultaneously exhibit both positive and negative Laplace pressures, whereas a normal surface would only support either positive or negative pressures. This enhances the total Laplace pressure of the surface, which can be used to further enhance the capillary height and wicking. See, for example, Quéré, D. Wetting and roughness. *Annual Review of Materials Research* 38, 71-99 (2008), which is incorporated by reference in its entirety. To demonstrate this ability, another capillary height experiment was conducted in which the channels were prefilled, but no pool of liquid was used such as in FIG. 5C and FIG. 5D. Instead, the capillary height was increased by gradually tilting the prefilled surface starting from horizontal (FIG. 6B ii, in which ethanol was used). The observed capillary height (h enhanced) was the sum of the heights predicted by Eq. 1 for the positive (h+) and negative (h−) Laplace pressures. The sustainable capillary height of the surface was greatly increased for a variety of liquids with a range of intrinsic wettability (FIG. 14). This increase in total Laplace pressure has the potential to impact high performance systems that rely on wicking, for example, heat pipes and thermal management of emerging, high-performance electronics.

Further Applications of Bistable Wetting Surfaces: Switchable Wetting

In addition, because the surface is bistable, it is possible to actively switch the surface between wicking and repellent behavior (FIG. 6C). In this demonstration, liquid droplets with an intrinsic advancing contact angle of 91.6° were added to the reentrant channel surface. Initially, the surface was filled with air and as such, was repellent with high droplet mobility. However, by pumping the same liquid into the channels via a reservoir, the surface was switched to a wicking state where liquid added to the surface was sucked into the structures. By once again removing the liquid in the channel (achieved in this demonstration by exceeding the capillary height such that gravity naturally emptied the channels), the surface transitioned back to the repellent state, demonstrating a simple method for active tailoring of the surface wettability between the two extreme wetting states, which would typically require complex coatings and external stimuli to change the chemical nature of the surface. See, for example, Xin, B. & Hao, J. Reversibly switchable wettability. *Chemical Society Reviews* 39, 769-782 (2010), which is incorporated by reference in its entirety. Furthermore, even with active methods to tailor intrinsic contact angle such as electrowetting, controlled switching between these two extreme wetting states had not been achieved. See, for example, Kavousanakis, M. E. et al. How to achieve reversible electrowetting on superhydrophobic surfaces. *Langmuir* 34, 4173-4179 (2018), which is incorporated by reference in its entirety. The ability to switch between wetting states enables 'smart' surfaces with tunable wetting, useful in areas such as microfluidics, lab-on-a-chip, microrobotics, and emerging display technologies. See, for example, Kavousanakis, M. E. et al. How to achieve reversible electrowetting on superhydrophobic surfaces. Langmuir 34, 4173-4179 (2018); Pollack, M. G., Fair, R. B. & Shenderov, A. D. Electrowetting-based actuation of liquid droplets for microfluidic applications. *Applied Physics Letters* 77, 1725-1726 (2000); Chen, Y., Doshi, N., Goldberg, B., Wang, H. & Wood, R. J. Controllable water surface to underwater transition through electrowetting in a hybrid terrestrial-aquatic microrobot. *Nature Communications* 9, 2495 (2018); and Hayes, R. A. & Feenstra, B. J. Video-speed electronic paper based on electrowetting. *Nature* 425, 383 (2003), each of which is incorporated by reference in its entirety.

Further Applications of Bistable Wetting Surfaces: Selective Wetting

Figure 6D:
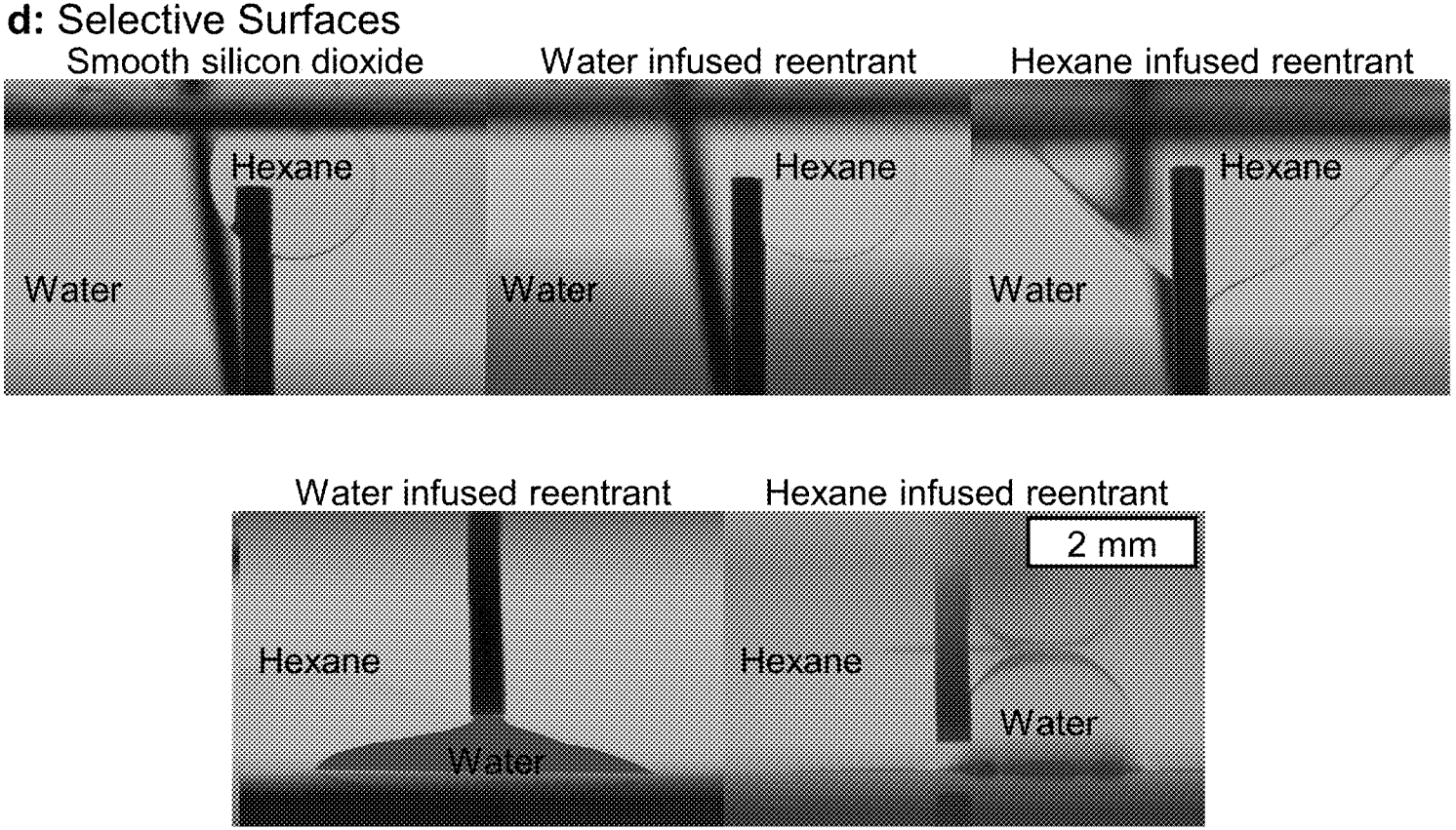

Finally, the wetting behavior of the reentrant structures is determined solely by the initial wetting state in other systems as well, i.e., liquid-liquid mixtures. Therefore, although the previously described experiments were demonstrated in liquid-air systems, by infusing (prefilling) reentrant microstructures with a desired liquid, selective wetting of surfaces was enabled. One liquid may be selectively wicked or repelled in the presence of another liquid without the need for complex chemical coatings. In this demonstration, reentrant channels without the $C_4F_8$ coating, i.e., a simple silicon and silicon dioxide surface without a chemical coating, were able to repel and absorb both hexane in a water environment and vice versa (FIG. 6D). In the first image, a smooth silicon dioxide surface is phobic to a hexane droplet in a water environment. The surface is inverted because hexane is less dense than water. For convenience, the hexane droplets in a water environment were dyed yellow and the water droplets in a hexane environment were dyed blue. By infusing the reentrant channels with either water or hexane (second and third images) the surface could be made either repellent or wetting to the hexane. Similarly, the same behavior could be achieved for water in a hexane environment (fourth and fifth images). Therefore, the same ability to tailor wetting behavior independent of intrinsic wettability also exists in liquid-liquid systems (FIG. 15). This flexibility in creating selective surfaces could be beneficial for many applications such as liquid separation, oil-spill remediation, and for the creation of lubricant infused surfaces. See, for example, Yang, J. et al. Superhydrophilic-superoleophobic coatings. *Journal of Materials Chemistry* 22, 2834-2837 (2012); Wang, B., Liang, W., Guo, Z. & Liu, W. Biomimetic super-lyophobic and super-lyophilic materials applied for oil/water separation: a new strategy beyond nature. *Chemical Society Reviews* 44, 336-361 (2015); Wong, T.-S. et al. Bioinspired self-repairing slippery surfaces with pressure-stable omniphobicity. *Nature* 477, 443-447 (2011); and Preston, D. J., Song, Y., Lu, Z., Antao, D. S. & Wang, E. N. Design of lubricant infused surfaces. *ACS Applied Materials & Interfaces* 9, 42383-42392 (2017), each of which is incorporated by reference in its entirety.

Both omniphilicity and omniphobicity can be achieved with reentrant surface structuring, which enables rational control over wetting behavior on a surface independent of intrinsic wettability of the material/liquid combination used. Furthermore, functional surfaces such as switchable omniphilicity and omniphobicity, as well as selective wicking and repellency, can be achieved using this surface design. Although challenges remain in fabrication and mechanical durability, reentrant microstructures promise to impact many high-performance technologies that utilize tailored wettability.

Methods

Fabrication of Surfaces

The fabrication procedure of both normal and reentrant channels is depicted in FIGS. 10A-10B. Each step is described in further detail here.

Photoresist Exposure and Development (FIG. 10A i)

A 2.5 μm layer of photoresist (Microposit S1822) was spin coated on polished silicon wafers that had a 1 μm thick silicon dioxide layer on the surface. The photoresist was exposed using an MLA150 Maskless Aligner. The resist was developed for 120 seconds in Microposit MF CD26 developer.

Reactive Ion Etch (FIG. 10A ii)

The silicon dioxide was first etched using $CF_4$ (MPX/LPX RIE, STS). Then, the channels were etched in the silicon with deep reactive ion etching (Rapier DRIE, SPTS).

Oxide Removal (FIG. 10A iii)

For normal channels, the silicon dioxide was removed by placing the samples in 7:1 buffered oxide etch solution for 10 minutes.

$SF_6$ Etch (FIG. 10B iii)

An isotropic $SF_6$ etch (Rapier DRIE, SPTS) was used to remove silicon below the silicon dioxide to create the reentrant geometry.

$C_4F_8$ Deposition (FIGS. 10A-10B iv)

A conformal, 60 nm thick hydrophobic polymer ($C_4F_8$) was deposited (Rapier DRIE, SPTS). This allowed a large range of intrinsic contact angles to be tested and also created surfaces with uniform and consistent wettability.

Contact Angle Measurements

A custom-built experimental setup was used to measure contact angle (FIG. 16A). The air and liquid temperature remained close to the surrounding laboratory temperature. A syringe pump (Micro4, World Precision Instruments) was used to add and remove water from a droplet on the surface. Note that the liquid was added and removed slowly enough that there was no dynamic effect on the contact angle, i.e., the capillary number was small. A DSLR camera (EOS Rebel T3, Cannon) and macro lens were used to collect images of the droplet advancing on the surface. Lighting of the droplet was supplied with a light source (Intenselight C-HGFI, Nikon) and lens (C-HGFIB, Nikon). Contact angle was extracted from the images using ImageJ. For contact angle measurements of reentrant surfaces in the repellent state, the droplet was added to a dry surface, i.e., air within the surface structures. For the hemiwicking state, the droplet was added to a surface prefilled with the same liquid as that in the syringe.

Capillary Height Measurements

A custom-built experimental setup was used to measure the capillary height for each sample (FIG. 16B). The samples were attached to a linear stage with a Vernier scale. This allowed the surfaces to be dipped into or withdrawn from a large pool of liquid. The Vernier scale (accurate to $1/100^{th}$ of an inch) was used to determine the capillary height. In order to test the repellent state of reentrant surfaces, the initially dry surface was lowered into the liquid. A camera recorded the surface as it was lowered into the liquid. When the maximum negative capillary height into the liquid was exceeded, liquid entered the structures. The height at which this occurred was recorded. Similarly, to test the hemiwicking state of reentrant surfaces, the surfaces were prefilled with the liquid to be tested. The surface was then withdrawn from the pool of liquid. When the maximum positive capillary height of the liquid was exceeded, air entered the structures and the liquid receded. The height at which this occurred was recorded.

Prefilling Surface Structures

Prefilling the reentrant channels with liquid was achieved using a variety of methods. For naturally wicking liquids, the liquid was added to one end of the channels and in turn, filled the channels spontaneously. For ethanol/water mixtures that were not wicking, the channels were first filled with pure ethanol. Next, the ethanol filled sample was placed in a large container of the ethanol/water mixture to be tested. The pure ethanol within the surface structures was allowed to diffuse into the mixture, thereby replacing the ethanol in the channels with the mixture. Note that the volume of ethanol in the channels was on the order of ten microliters, whereas the container was more than one thousand times this size. Therefore, this filling method did not affect the final concentration of the mixture. Samples were then removed from the mixture such that the channels remained filled to conduct contact angle or capillary height measurements. For mercury, prefilling was achieved by vacuum filling the reentrant microstructures. The surface was placed in a small chamber, the chamber was then evacuated of air to less than 10 Pa, after which the chamber was filled with mercury, thereby ensuring the reentrant structures were completely filled with this highly non-wetting liquid.

Selective Wicking and Repellency Experiments

The measurement was done with the same setup for the contact angle measurement. Two immiscible liquids, water and hexane, were used for testing. First, a drop of one of two liquids was placed on a flat surface while the entire surface was submerged in the other liquid to confirm the intrinsic contact angle, θ. Then, the selective wicking was achieved by infusing the same liquid as the droplet into the reentrant structures. On the other hand, the repellency was achieved by infusing the other liquid into the reentrant structures. In the case of testing the wettability of hexane within a water environment, due to the density difference of two liquids, the surface was flipped upside-down and a syringe was placed under the surface to add a hexane droplet.

Switching Between Wicking and Repelling Experiments

To demonstrate the ability to switch between states, the reentrant channels were tilted at an angle of 30°. The surface was initially dry. Therefore, when a syringe added a liquid mixture of 83% water and 17% ethanol to the surface, a droplet was formed in the Cassie state and thereby repelled. However, by adding the same liquid to the channels using a pump, a droplet added to the surface formed the hemiwicking state and was wicked into the surface structures. When enough liquid was added to the tilted surface, hydrostatic pressure from gravity caused the liquid within the structure to spontaneously dewet from the channel, thereby recovering the state filled with air. As such, the repellent Cassie state was recovered. This process was continuously repeated multiple times.

Wetting States on Structured Surfaces

Three distinct wetting states occur on structured surfaces. The first is the highly-wetting, hemiwicking state, where liquid completely fills the roughness (FIG. 7A). The behavior in this state may be understood by starting with a basic form of the Cassie-Baxter relation that describes the apparent contact angle of a liquid placed on a composite surface consisting of two distinct materials (see, for example, Dettre, R. & Johnson, R. Contact angle hysteresis, I. Study of an idealized rough surface. *Advances in Chemistry Series* 43, 112 (1964), which is incorporated by reference in its entirety):

$$\cos\theta^* = f_1 \cos\theta_1 + f_2 \cos\theta_2 \quad \text{(S1)}$$

where $f_1$ and $f_2$ are the areal fractions of the two different materials that constitute the wetted surface. $\theta_1$ and $\theta_2$ are the intrinsic contact angles of liquid on those materials, respectively. For a flat surface consisting of two distinct materials, $f_1+f_2=1$. However, if the material is roughened, $f_1+f_2=r$, where r is the roughness factor of the surface, i.e., the ratio of total surface area including the roughness to that of the projected area. When liquid is placed on a surface that exhibits hemiwicking, any liquid that does not wick into the roughness sits on a composite interface consisting of a solid-liquid interface and a liquid-liquid interface (where the liquid within the roughness is treated as material 2 in Eq. S1). In this scenario, because material 2 is the liquid itself, $\theta_2=0°$, and Eq. S1 reduces to:

$$\cos\theta^*=f_1\cos\theta_1+f_2 \tag{S2}$$

For the hemiwicking case, $f_1$ then becomes the roughness and solid fraction of the reentrant feature only (called $r_1$), $r_1\phi$, and $f_2=(1-\phi)$.

In the Wenzel state, which is an intermediate wetting state, liquid fills the roughness but does not spread further (FIG. 7B). Therefore, this is no longer treated as a composite interface. Instead, it is treated as liquid on a rough surface consisting of one material where $f_2=0$ and $f_1=r$. Note that the roughness used for the Wenzel state is different than that for Eq. S2 and Eq. S3 in that it is the roughness of the entire surface and not only the reentrant feature.

Finally, in the Cassie state, the liquid does not penetrate the surface roughness (FIG. 7C). Therefore, the liquid on the surface is suspended on a composite interface consisting of the solid material and air, and when properly designed is highly repellent. In this case, the second material is air and $\theta_2=180°$. Eq. S1 reduces to:

$$\cos\theta^*=f_1\cos\theta_1-f_2 \tag{S3}$$

Once again, $f_1$ then becomes the roughness and solid fraction of the reentrant feature, $r_1\phi$, and $f_2=(1-\phi)$.

Furthermore, based on surface energy, one can predict critical intrinsic contact angles at which each of these states is expected to occur. When $\cos\theta>(1-\phi))/(r-\phi)$, the hemiwicking state is expected. See, for example, Bico, J., Tordeux, C. & Quéré, D. Rough wetting. *EPL* (*Europhysics Letters*) 55, 214 (2001), which is incorporated by reference in its entirety. Because the right-hand side of this inequality is always positive, the hemiwicking state is only expected for wetting liquids. Meanwhile, when $\cos\theta<-(1-\phi))/(r-\phi)$, the Cassie state is favorable. Therefore, the Cassie state is only expected for non-wetting liquids. At intermediate contact angles, the Wenzel state is expected.

Reentrant Surfaces for Repellency and Wicking of All Liquids

Reentrant structures achieve fluid repellency by trapping air underneath liquid on the surface via specific "reentrant" microstructures that prevent liquid from entering the roughness. The geometry takes advantage of the surface tension of the fluid to create a local energy barrier for fluid propagation which keeps liquid from entering the microstructure. Depending on the level of reentrance of the geometry, $\alpha$, the surface is able to repel fluids with different contact angles, $\theta$ (depicted in FIG. 8B). The black arrow in the schematics represents the direction of the surface tension force that prevents liquid from entering the structure. For a normal microstructure ($\alpha\leq 0°$), the surface tension force only acts to prevent liquid entering the microstructure if $\theta>90-\alpha$. As the level of reentrance increases, the surface is able to repel liquids with lower contact angles. A reentrant microstructure ($0°<\alpha\leq 90°$) can repel liquids with a contact angle less than 90°. However, for perfectly wetting fluids with $\theta=0°$, the surface tension force would no longer have a component in the vertical direction. Therefore, to be omniphobic and repel all fluids, including perfectly wetting fluids, a doubly reentrant microstructure is needed.

Likewise, reentrant structures may achieve hemiwicking of all liquids (omniphilic) in a similar manner as long as the liquid's initial state is filled in the reentrant structure (FIG. 8B). In this hemiwicking case, the surface tension force generated at the reentrant structure prevents liquid from being removed from the roughness.

Bistable Surfaces for Repellency and Wicking

The total surface energy was modeled as a function of the liquid volume while a wetting liquid is added to the reentrant structure and while a non-wetting liquid is removed from the structure (FIGS. 3A and 3B in the main text). The calculation was based on a unit depth of the unit cell with dimensions scaled to those of the reentrant surfaces that were fabricated and experimentally tested (see FIG. 3C). In the case of a wetting liquid, for state i, the total surface energy is given by $$E_1^w=\gamma_{sg}(4D+l+2H) \tag{S4}$$

where $\gamma_{sg}$ is the surface energy of solid-gas interfaces and the thickness of the overhang is assumed to be minimal compared to other dimensions. The initial gas volume is set to be $V_0$. As liquid is added from above, more solid-gas interfaces are replaced by liquid-gas interfaces. The top corner of the overhang creates a local energy barrier, where the three phase contact line pins. As pinning occurs, with more liquid added to the system, the liquid-gas and solid-gas interface area stays the same while the liquid-gas interface area decreases until the liquid-gas interface becomes flat (state iii). Between state ii and state iii, the total surface energy is $$E_{23}^w=\gamma_{sg}(4D+l-d+2H)+\gamma_{sl}d+2\gamma_{lg}R_{lg}(\pi-\xi) \tag{S5}$$

where $\gamma_{sl}$ is the surface energy for solid-liquid interfaces, $\gamma_{lg}$ is the surface energy for liquid-gas interfaces, $R_{lg}$ is the radius of curvature of the liquid-gas interface, and $\xi$ is the contact angle of the liquid front with regard to the top surface. During this stage, $\theta<\xi<\pi$ and $$R_{lg}=\frac{l-d}{2\cos\left(\xi-\frac{\pi}{2}\right)} \tag{S6}$$

and the liquid volume can be written as $$V_{23}^w=V_0-(l-d)H-R_{lg}^2\left[(\pi-\xi)-\frac{\sin 2(\pi-\xi)}{2}\right] \tag{S7}$$

After state iii, the liquid-gas interface area starts increasing again while more liquid was added into the system. Between state iii and state iv, the total surface energy is $$E_{34}^w=\gamma_{sg}(4D+l-d+2H)+\gamma_{sl}d+2\gamma_{lg}R_{lg}\psi \tag{S8}$$

where $\psi$ is the contact angle of the liquid front with respect to the bottom surface of the overhang, which varies from 0 to $\theta$. During this stage, $$R_{lg}=\frac{l-d}{2\cos\psi} \tag{S9}$$

and the liquid volume can be described as $$V_{34}^{w} = V_0 - (l-d)H + R_{lg}^2\left[\left(\psi - \frac{\sin 2\psi}{2}\right)\right] \quad \text{(S10)}$$

Adding more liquid after $\psi=\theta$ results in the solid-liquid interface area replacing the solid-gas interface area inside the structure. Eventually, at state v, the unit cell is filled with liquid, and the total surface energy is $$E_5^{w}=\gamma_{sl}(4D+l+2H) \quad \text{(S11)}$$

In the case of removing non-wetting liquid from the unit cell, at state i, the unit cell is filled with liquid, so $$E_1^{nw}=\gamma_{sl}(4D+l+2H). \quad \text{(S12)}$$

Between state ii and state iii, $$E_{23}^{nw}=\gamma_{sl}(4D+l-d+2H)+\gamma_{sg}d+2\gamma_{lg}R_{lg}\chi, \quad \text{(S13)}$$

where $\chi$ is the contact angle of the liquid front with respect to the top surface, and $$R_{lg} = \frac{l-d}{2\cos\chi} \quad \text{(S14)}$$

The liquid volume during this stage is $$V_{23}^{nw} = (l-d)H + R_{lg}^2\left[(\pi-\xi) - \frac{\sin 2\chi}{2}\right] \quad \text{(S15)}$$

Between state iii and state iv, $$E_{34}^{nw}=\gamma_{sl}(4D+l-d+2H)+\gamma_{sg}d+2\gamma_{lg}R_{lg}(\pi-\varphi) \quad \text{(S16)}$$

where $\varphi$ is the contact angle of the liquid front with respect to the bottom surface of the overhang, and during this stage, $$R_{lg} = \frac{l-d}{2\cos(\pi-\varphi)} \quad \text{(S17)}$$

The liquid volume can be expressed as $$V_{34}^{nw} = V_0 - (l-d)H + R_{lg}^2\left[\left(\psi - \frac{\sin 2(\pi-\varphi)}{2}\right)\right] \quad \text{(S18)}$$

When the liquid is completely removed from the unit cell, the total surface energy then becomes $$E_5^{nw}=\gamma_{sg}(4D+l+2H) \quad \text{(S19)}$$

Figure 3C:
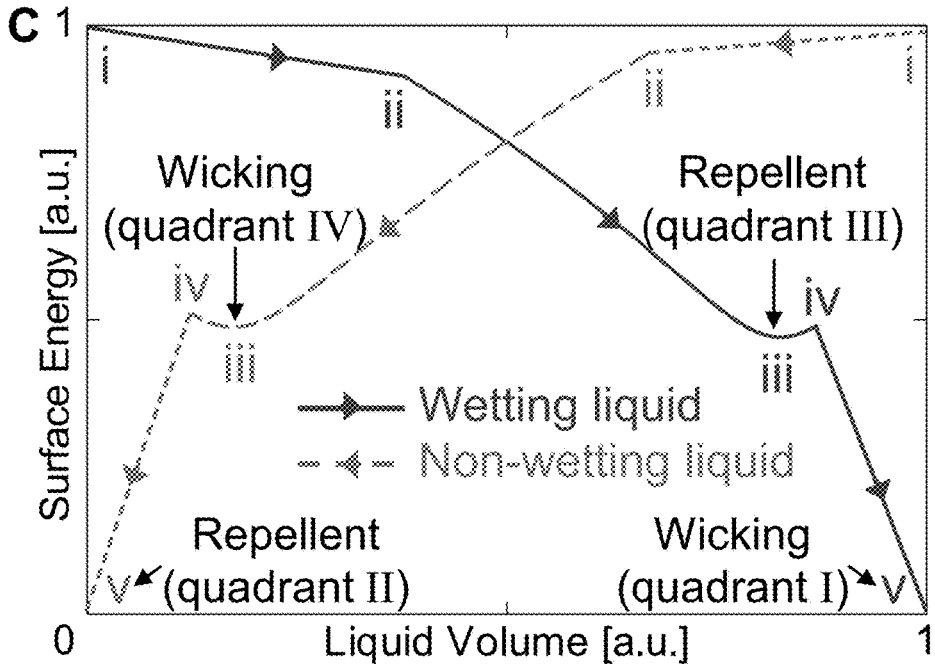

Note that in FIG. 3C, the total surface energy and the liquid volume are normalized to take values between 0 and 1. Therefore, the values in FIG. 3C do not have specific physical meanings whereas the trend does show that a stable energy state (a local energy minimum) exists for both wicking and repelling independent of the intrinsic wettability of the liquid/surface used.

Wetting Parallel and Perpendicular to Channels

Although Eq. S1 predicts a single value for the apparent contact angle on a surface, a range of values have often been observed due to distortion of the three-phase contact line and variation in the surface solid fraction on the heterogeneous surface. See, for example, Gao, L. & McCarthy, T. J. How Wenzel and Cassie were wrong. *Langmuir* 23, 3762-3765 (2007), which is incorporated by reference in its entirety. Therefore, the "local" solid fraction at the three-phase contact line has been used. See, for example, McHale, G. Cassie and Wenzel: were they really so wrong? *Langmuir* 23, 8200-8205 (2007); Panchagnula, M. V. & Vedantam, S. Comment on how Wenzel and Cassie were wrong by Gao and McCarthy. *Langmuir* 23, 13242-13242 (2007); and Choi, W., Tuteja, A., Mabry, J. M., Cohen, R. E. & McKinley, G. H. A modified Cassie-Baxter relationship to explain contact angle hysteresis and anisotropy on non-wetting textured surfaces. *Journal of Colloid and Interface Science* 339, 208-216 (2009), each of which is incorporated by reference in its entirety. The solid-fraction of the three-phase contact line may vary when a droplet moves perpendicular to the channels (compare planes 3 and 4 in FIG. 11). However, parallel to the channels, the solid fraction remains constant (e.g., comparing planes 1 and 2 in FIG. 11). As such, the contact angle measurement parallel to the channels was used while interpreting the experimental results. Parallel to the channels $\phi=d/l$ and for the Wenzel state $r=(2h+l)/l$.

Derivation of Capillary Height Equation for Reentrant Channels

A rough surface dipped into a liquid exhibits a capillary height, h, similar to a capillary tube. This capillary height is a function of the geometry of the surface roughness, the liquid properties, and the contact angle formed between the liquid and the solid. The surface tension of the liquid produces a force, $F_1$, which can either prevent liquid from entering the roughness or draw the liquid into the roughness. The vertical component of this force, $F_{1,y}$, dictates the behavior and for a normal channel (FIG. 13A) is given by:

$$F_{1,y}=\gamma L\cos\theta \quad \text{(S20)}$$

where $\gamma$ is the surface tension of the liquid and L is the length of the channel. If the liquid is wetting ($\theta<90°$), this force is positive and if the surface is non-wetting ($\theta>90°$), the force is negative. Therefore, the pressure a channel can withstand, $P_L$, is the sum of the forces on both sides of the channel, divided by the projected area of the channel:

$$-P_L = \frac{2F_{1,y}}{(l-d)L} = \frac{2\gamma\cos\theta}{(l-d)} \quad \text{(S21)}$$

In this equation, $\theta$ and d dictate the curvature of the liquid-gas interface and is therefore the same equation as that for the Laplace pressure. See, for example, De Gennes, P.-G. Wetting: statics and dynamics. *Reviews of Modern Physics* 57, 827 (1985), which is incorporated by reference in its entirety. Meanwhile, the hydrostatic pressure, $P_h$, as a function of liquid height is:

$$-P_h=\Delta\rho gh \quad \text{(S22)}$$

where $\Delta\rho$ is the density difference between the liquid and air and g is the gravitational acceleration. By setting $P_L$ equal to $P_h$ and rearranging for h it was found that:

$$h = \frac{2\gamma\cos(\theta)}{(l-d)\Delta\rho g} \quad \text{(S23)}$$

However, the reentrant structure modifies the apparent contact angle in the channel (Fig. S7*b*). In the Cassie state, the reentrant feature increases the contact angle by $\alpha$, whereas in the hemiwicking state, it reduces the contact angle by α. Eq. S23 is then modified to account for reentrance as:

$$h = \frac{2\gamma\cos(\theta \pm \alpha)}{(l-d)\Delta\rho g} \tag{S23}$$

Finally, it was also recognized that due to contact line pinning the maximum force may not occur at θ+α. Rather, as the liquid advances or recedes in the reentrant channel the maximum vertical component of the contact line force occurs when θ+α=180° for the Cassie state and θ−α=0° for the hemiwicking state (Fig. S7*c*). Therefore in the Cassie state, when θ+α>180°, the liquid entering the structure must pass through this maximum and θ+α is set to 180° instead. Similarly, when θ−α<0°, θ−α was set to 0 for the hemiwicking state.

Uncertainty Propagation

This section presents the method used for uncertainty propagation of the experimental results. The method for determining uncertainty is described in NIST Technical Note 1297. See, for example, Taylor, B. N. & Kuyatt, C. E. *Guidelines for evaluating and expressing the uncertainty of NIST measurement results*. (Citeseer, 1994), which is incorporated by reference in its entirety. Individual measurements are assumed to be uncorrelated and random. Therefore, the uncertainty, U, in a calculated quantity, Y, is determined as $$U = \sqrt{\sum_i \left(\frac{\partial Y}{\partial X_i}\right)^2 U_x^2} \tag{S25}$$

where X is the measured variable, and $U_x$ is the uncertainty in the measured variable. Table 3 summarizes the uncertainty associated with each experimental measurement that was then propagated according to Eq. S25 to determine uncertainty.

Liquid placed on top of channels rests on a heterogeneous surface. As the liquid moves in different directions, the three-phase contact line observes a different solid fraction. Solid fraction at plane 1 and 2 was compared. As the droplet moves parallel to the channels, the surface the three-phase contact line interacts with remains the same. However, when the droplet moves perpendicular to the channels, the three-phase contact line may observe different solid fractions ranging from 0 to 1 (plane 3 and 4, respectively). This causes the wetting behavior to not be axisymmetric and creates contact angle hysteresis in the direction perpendicular to the channels. However, due to the uniform solid-fraction in the direction parallel to the channels, there is little contact angle hysteresis. The wetting behavior on channels has also been well-characterized in the literature. See, for example, Choi, W., Tuteja, A., Mabry, J. M., Cohen, R. E. & McKinley, G. H. A modified Cassie-Baxter relationship to explain contact angle hysteresis and anisotropy on non-wetting textured surfaces. *Journal of Colloid and Interface Science* 339, 208-216 (2009), which is incorporated by reference in its entirety. Therefore, the wetting behavior parallel to the channels as it accurately captures the behavior expected from Eq. S1, for which ϕ=d/l and r=1 for the hemiwicking and Cassie state and r=(2h+l)/l for the Wenzel state is shown.

Apparent receding contact angle (cos θ*) on reentrant microstructures parallel to the channels for liquids with different intrinsic wettability (cos θ), where the receding contact angle on a smooth surface is used for the intrinsic wettability. The same behavior was observed as that for the advancing contact angle in FIG. 3*d*.

Normalized capillary height on normal and reentrant channels for liquids with different intrinsic wettability. The normal channels highlight typical behavior, where non-wetting liquids trap air to a given liquid depth and wetting liquids fill the roughness to a given height (triangles). Reentrant channels dipped in liquid, however, trap air for wetting liquids as well (red squares). Similarly, when pre-filled with liquid, reentrant channels allow a positive capillary height for all liquids (blue squares). Furthermore, the reentrant surface is able to sustain both negative and positive Laplace pressures simultaneously. Therefore, reentrant structures further enhance the capillary height by utilizing both Laplace pressures (purple filled squares). These measurements were conducted by prefilling the channels, but not dipping the channels into a pool of liquid. Instead, the channels were initially horizontal and were then tilted. As the surface was tilted the hydrostatic pressure increased. The point at which the liquid dewet from the channel was recorded as the enhanced capillary height, h enhanced. The purple solid line is the sum of the positive and negative capillary height predictions.

Apparent advancing contact angle (cos θ*) on reentrant microstructures parallel to the channels for liquid/liquid systems with different intrinsic wettability (cos θ), where the advancing contact angle on a smooth surface is used for the intrinsic wettability. Data was taken from images in FIG. 4D, and the same trends were seen as for liquid-air systems. Both wicking and repellency can be achieved regardless of the intrinsic contact angle. No low-surface energy coating was used in these tests, i.e., the surface was simply silicon and silicon dioxide.

TABLE 1

Tested surfaces

| Sample # | l [μm] | d [μm] | H [μm] | t [μm] | D [μm] | α [deg] | ϕ [—] | r [—] | $r_1$ [—] | Critical cosθ [—] |
|---|---|---|---|---|---|---|---|---|---|---|
| 1 | 500 | 90 | 400 | — | — | 0 | 0.18 | 2.6 | 1 | ±0.34 |
| 2 | 500 | 90 | 400 | 1 | 25 | 90 | 0.18 | 2.7 | 1 | ±0.33 |

Geometric parameters of tested surfaces. l is pitch, d is width of the channel wall or reentrant feature, h is the channel height, t is the thickness of the reentrant feature, D is the length of the reentrant overhang, α is the reentrance angle, ϕ is the surface solid fraction, r is the roughness factor of the entire surface, $r_1$ is the roughness factor of the reentrant feature or in the case of normal channels of the top of the channel wall, and the critical contact angle is the intrinsic contact angle at which the hemiwicking and Cassie states are expected to occur.

TABLE 2

| Liquid properties | | | | | |
|---|---|---|---|---|---|
| Liquid [weight percent] | Surrounding environment | Density [kg/m$^3$] | Surface tension [N/m] | $\theta_{adv}$ [degrees] | $\theta_{rec}$ [degrees] |
| Mercury | Air | 13690 | 0.430 | 143.6 | 132.1 |
| Water | Air | 997 | 0.0721 | 116.0 | 95.8 |
| 92% Water, 8% Ethanol | Air | 986 | 0.0599 | 105.0 | 90.0 |
| 83% Water, 17% Ethanol | Air | 973 | 0.0502 | 91.6 | 69.4 |
| 68% Water, 32% Ethanol | Air | 949 | 0.0402 | 74.6 | 57.3 |
| 38% Water, 62% Ethanol | Air | 888 | 0.0302 | 56.4 | 40.3 |
| Ethanol | Air | 789 | 0.0232 | 43.0 | 30.5 |
| FC-40 | Air | 1855 | 0.0160 | 3.0 | 0 |
| Water | Hexane | 997 | 0.0721* | 25.4 | — |
| Hexane | Water | 655 | 0.0184* | 150 | — |

Properties of tested liquids. Water and ethanol are soluble, and may therefore be used to create liquids with a range of surface tensions and contact angles ENREF_9_ENREF_9. See, for example, Vazquez, G., Alvarez, E. & Navaza, J. M. Surface tension of alcohol + water from 20 to 50 degree C. *Journal of Chemical and Engineering Data* 40, 611-614 (1995), which is incorporated by reference in its entirety. Weight percentages of the components are listed.
*Surface tension values are for the liquid in air.

TABLE 3

| Uncertainty<br>Uncertainties of measurements. | |
|---|---|
| Experimental Measurement | Uncertainty |
| Contact angle measurement ($\theta$) | 5° |
| Capillary height measurement (h) | 1 mm |
| Ethanol/water mixture weight percent | ± 2% |

The Hemiwicking State

A highly wetting liquid (ethanol) was added to the normal channels. The 10 channels ran horizontally across the surface. On either side of the channels were flat regions of the surface. The liquid was wicked into the channels and spread across the surface. As such, the liquid formed the hemiwicking state and exhibited a low contact angle.

The Wenzel State

A moderately wetting liquid, 68% water and 32% ethanol, was added to the normal channels. The 10 channels ran horizontally across the surface. On either side of the channels were flat regions of the surface. The liquid filled the channels below the droplet of liquid, but did not spread further. Therefore, the liquid was in the Wenzel state.

The Cassie State

A non-wetting liquid, water, was added to the normal channels. The 10 channels ran horizontally across the surface. On either side of the channels were flat regions of the surface. Air was trapped within the channels with the water droplet in the Cassie state. As such, the surface was repellent and allowed the droplet to be easily removed.

Repelling Wetting Liquids

A highly wetting liquid, ethanol, was added to the reentrant channels. The 10 channels ran horizontally across the surface. On either side of the channels were flat, unstructured regions of the surface. Despite the ethanol being highly wetting, the reentrant channels allowed a Cassie state to be formed so that the liquid was repelled due to the omniphobic behavior. Therefore, when the ethanol droplet grew large enough to contact the unstructured portion of the surface, the ethanol spontaneously moved to that region due to its wetting nature.

Wicking Non-Wetting Liquids

A non-wetting liquid, water, was added to the reentrant channels that were prefilled with water. The 10 channels ran horizontally across the surface. On either side of the channels were flat, unstructured regions of the surface. The droplet initially contacted a flat region and had a large contact angle due to the hydrophobic coating. However, despite the non-wetting nature of the droplet, when the liquid contacted the channels, it was wicked in due to the omniphilic behavior of prefilled reentrant channels.

Positive Capillary Heights

As the prefilled reentrant channels were raised from a pool of liquid (83% water and 17% ethanol), the liquid remained trapped within the channels. At a given height, known as the capillary height, the negative hydrostatic pressure became too large and liquid was forced to recede from the channels. Because the reentrant channels were enabling a metastable wetting state, the liquid in the channels moved downwards towards the surface of the pool of liquid after the capillary height was exceeded. The same surface and liquid was used below.

Negative Capillary Heights

As the reentrant channels were lowered into a pool of liquid (83% water and 17% ethanol), air remained trapped within the channels. At a given depth, known as the capillary height, the hydrostatic pressure became too large and liquid was pushed into the channels. Because the reentrant channels were enabling a metastable wetting state, the liquid that entered the channels moved upward towards the surface of the pool of liquid after the capillary height was exceeded. The same surface and liquid was used as above.

Enhancing the Capillary Height

To begin, reentrant channels prefilled with ethanol were placed horizontal and connected to a linear stage. The surface was then tilted by adjusting the linear stage in order to increase h. When the capillary height was exceeded, liquid from the higher portion of the channels receded and burst from the lower portion of the channels. The observed enhanced capillary height was the sum of the capillary heights predicted by the positive and negative Laplace pressures.

Switching Between Repellency and Wicking

Droplets of a liquid with $\theta$=91.6°, a mixture of 83% water and 17% ethanol, were added to the reentrant channel surface, tilted at an angle of 30°. The surface was initially dry. Therefore, droplets were formed in the Cassie state and repelled (0 to 7 seconds). However, by pumping liquid into the channel from a reservoir, a droplet added to the surface formed the hemiwicking state and was wicked into the surface structures (8 to 17 seconds). When enough liquid was added to the tilted surface hydrostatic pressure from gravity caused the liquid within the structure to spontaneously dewet from the channel (18 to 20 seconds), thereby recovering the repellent Cassie state filled with air (22 seconds). This process was repeated multiple times to demonstrate switchability between wicking and repellency.

Details of one or more embodiments are set forth in the accompanying drawings and description. Other features, objects, and advantages will be apparent from the description, drawings, and claims. Although a number of embodiments of the invention have been described, it will be understood that various modifications may be made without departing from the spirit and scope of the invention. It should also be understood that the appended drawings are not necessarily to scale, presenting a somewhat simplified representation of various features and basic principles of the invention.

What is claimed is:

1. A selective wetting surface comprising:

a reentrant structure on a surface having a bistable surface, wherein the surface has omniphobic and omniphilic behaviors or is selectively repelling or wicking, wherein the surface is switchable between repelling, wicking or selective.

2. The selective wetting surface of claim 1, wherein selective includes repelling or wicking a particular liquid or set of liquids.

3. The selective wetting surface of claim 1, wherein the reentrant structure is a doubly reentrant structure.

4. The selective wetting surface of claim 1, wherein the reentrant structure includes microchannels, pillars or cavities.

5. The selective wetting surface of claim 1, wherein the reentrant structure is a coated structure.

6. The selective wetting surface of claim 1, wherein the reentrant structure is filled with a liquid.

7. The selective wetting surface of claim 6, wherein the liquid is a non-wetting liquid for the surface.

* * * * *